US012778272B2

(12) United States Patent
Somarriba et al.

(10) Patent No.: US 12,778,272 B2
(45) Date of Patent: Nov. 3, 2026

(54) PERSONAL HYDRATION SYSTEMS

(71) Applicant: HydraPak LLC, Oakland, CA (US)

(72) Inventors: Kevin Somarriba, Hayward, CA (US); Gordon Chesebro, Oakland, CA (US)

(73) Assignee: HydraPak LLC, Oakland, CA (US)

( * ) Notice: Subject to any disclaimer, the term of this patent is extended or adjusted under 35 U.S.C. 154(b) by 437 days.

(21) Appl. No.: 18/204,300

(22) Filed: May 31, 2023

(65) Prior Publication Data

US 2023/0389681 A1 Dec. 7, 2023

Related U.S. Application Data

(60) Provisional application No. 63/347,941, filed on Jun. 1, 2022.

(51) Int. Cl.
*A45F 3/20* (2006.01)
*A45F 3/16* (2006.01)

(52) U.S. Cl.
CPC ..... *A45F 3/20* (2013.01); *A45F 3/166* (2025.01)

(58) Field of Classification Search
CPC .... A45F 3/20; A45F 3/04; A45F 3/166; A45F 2003/045; B65D 75/5877; B65D 33/02; B65D 33/06; B65D 33/1658
USPC ..... 222/175, 105, 490
See application file for complete search history.

(56) References Cited

U.S. PATENT DOCUMENTS 1,959,782 A * 5/1934 Fenwick, Jr. ..... A62C 8/02 383/41
2,013,358 A 9/1935 Osborne
3,231,901 A 2/1966 Kennedy
3,437,117 A 4/1969 Vitello et al.
4,541,117 A 9/1985 Ashbeck
4,911,562 A 3/1990 Mazzeschi
5,115,947 A 5/1992 McDonnell et al.
5,282,557 A * 2/1994 McCook ..... A45F 3/16 224/640
5,361,955 A 11/1994 Gregory
5,427,290 A 6/1995 Thatcher
D366,142 S * 1/1996 Becker ..... D3/221
5,730,336 A 3/1998 Lerner
5,816,457 A 10/1998 Croft
5,864,880 A 2/1999 Adam
(Continued)

FOREIGN PATENT DOCUMENTS

CA 3031739 12/2017
CN 2676714 2/2005
(Continued)

OTHER PUBLICATIONS

English-language machine translation of Chinese Patent Application No. CN102090778A, May 15, 2011.
(Continued)

*Primary Examiner* — Charles P. Cheyney
(74) *Attorney, Agent, or Firm* — KOLITCH ROMANO DASCENZO GATES LLP

(57) ABSTRACT

Personal hydration systems (10) comprise a reservoir assembly (11) that comprises a flexible bladder (12) that defines an internal compartment (14) for holding a volume of drink liquid (16); a fill port assembly (18) coupled to the flexible bladder (12) and defining an opening (20) to the internal compartment (14); and an exit port (22) coupled to the flexible bladder (12).

30 Claims, 12 Drawing Sheets

(56) References Cited

U.S. PATENT DOCUMENTS 5,884,372 A 3/1999 Anscher et al.
5,913,456 A * 6/1999 Dikeman ..... B62J 11/16 383/68
5,951,076 A 9/1999 Marco
6,039,305 A 3/2000 Hoskins et al.
6,176,394 B1 1/2001 Shimko et al.
6,247,619 B1 * 6/2001 Gill ..... B62J 9/26 222/105
6,557,721 B2 5/2003 Yang
6,666,360 B1 12/2003 Swank
6,675,998 B2 1/2004 Forsman et al.
6,695,269 B1 2/2004 Anscher
6,764,064 B2 7/2004 Sturm et al.
6,820,780 B2 11/2004 Forsman et al.
6,994,269 B2 2/2006 Lien
7,014,077 B2 3/2006 Brown
7,063,243 B2 6/2006 Forsman et al.
7,070,075 B2 7/2006 Forsman et al.
7,083,063 B2 * 8/2006 Lien ..... B65D 33/06 220/291
7,334,707 B2 2/2008 Hoskins
7,448,509 B2 11/2008 Yang
7,464,837 B2 12/2008 Hoskins
7,490,740 B2 2/2009 Robins et al.
7,600,656 B2 10/2009 Karl et al.
7,621,294 B2 11/2009 Wang
7,648,276 B2 1/2010 Gill
7,703,633 B2 4/2010 Chen
7,762,432 B2 7/2010 Fidrych et al.
7,806,300 B1 10/2010 Noell et al.
D640,466 S 6/2011 Staton
7,954,338 B2 6/2011 Lien
8,177,097 B2 5/2012 Duran
8,182,151 B2 5/2012 Dodgen
8,186,881 B2 5/2012 Lyon et al.
8,267,283 B2 * 9/2012 Staton ..... A45F 3/20 222/529
8,887,962 B2 11/2014 Herivel et al.
9,210,990 B2 12/2015 Hoskins
9,302,822 B2 4/2016 Hoskins
9,470,335 B2 10/2016 Hoskins
9,534,695 B2 1/2017 Hoskins
9,833,057 B2 12/2017 Lyon et al.
9,994,362 B2 6/2018 Hoskins
10,051,946 B1 8/2018 Lyon et al.
10,315,816 B2 6/2019 Ehyai et al.
10,624,438 B2 * 4/2020 Hoskins ..... A45F 3/20
D903,298 S 12/2020 Favela et al.
11,279,536 B2 3/2022 Ehyal et al.
11,357,314 B2 6/2022 Karl, IV et al.
11,432,640 B2 * 9/2022 Garvey ..... A45F 3/20
2002/0011583 A1 1/2002 Getzewich et al.
2002/0166990 A1 * 11/2002 Yang ..... B29C 45/14819 222/490
2002/0190080 A1 12/2002 Credle, Jr.
2003/0184103 A1 10/2003 Cauchy
2003/0189062 A1 10/2003 Credle, Jr.
2003/0222238 A1 12/2003 Getzewich et al.
2006/0151534 A1 * 7/2006 Mares ..... A45F 3/04 224/148.2
2007/0012733 A1 * 1/2007 Horito ..... A45F 3/20 224/148.2
2007/0034634 A1 2/2007 Brown
2007/0075094 A1 4/2007 Brown
2007/0152007 A1 7/2007 Kauss et al.
2007/0181616 A9 8/2007 Horito et al.
2008/0226200 A1 9/2008 Murray
2008/0277433 A1 11/2008 Karl et al.
2009/0206107 A1 8/2009 Raz et al.
2010/0040307 A1 2/2010 Lien
2010/0278455 A1 11/2010 Lyden et al.
2012/0111876 A1 * 5/2012 Pfotenhauer ..... A45F 3/04 220/669
2012/0175473 A1 7/2012 Fraze
2014/0374413 A1 * 12/2014 Lyon ..... A45F 3/18 220/613
2016/0060003 A1 3/2016 Wood
2016/0113379 A1 4/2016 Marui
2016/0236826 A1 8/2016 Hoskins
2016/0258542 A1 9/2016 Hoskins
2017/0127806 A1 5/2017 Smith et al.
2017/0240319 A1 8/2017 Lyon et al.
2019/0090617 A1 * 3/2019 Karl, IV ..... A45F 3/18
2019/0098989 A1 4/2019 Hoskins
2019/0270562 A1 9/2019 Ehyai et al.
2019/0320781 A1 * 10/2019 Hoskins ..... B65D 33/105
2020/0229578 A1 7/2020 Hoskins
2020/0237082 A1 7/2020 Willows et al.
2020/0290781 A1 9/2020 Hoskins et al.
2020/0352311 A1 11/2020 Garvey et al.
2021/0161279 A1 6/2021 Omizo et al.
2021/0300632 A1 9/2021 Yang et al.
2022/0015529 A1 * 1/2022 Hoskins ..... B65D 33/06
2023/0389681 A1 * 12/2023 Somarriba ..... A45F 3/20

FOREIGN PATENT DOCUMENTS

CN 2790257 6/2006
CN 2865402 2/2007
CN 201064265 5/2008
CN 201064267 5/2008
CN 201108147 9/2008
CN 102090778 6/2011
CN 201879037 6/2011
CN 202035656 11/2011
CN 202445413 9/2012
CN 203087991 7/2013
CN 104853647 8/2015
CN 204908398 12/2015
CN 205306253 6/2016
CN 206777019 12/2017
CN 207202448 4/2018
CN 208354901 1/2019
CN 212345713 1/2021
GB 2366833 3/2002
GB 2430135 3/2007
TW M437102 9/2012
WO 2000075030 12/2000
WO 2018208538 11/2018
WO 2019005702 1/2019

OTHER PUBLICATIONS

English-language machine translation of Chinese Patent Application No. CN104853647, Aug. 19, 2015.
English-language machine translation of Chinese Patent No. CN201064265Y, May 28, 2008.
English-language machine translation of Chinese Patent No. CN201064267Y, May 28, 2008.
English-language machine translation of Chinese Patent No. CN201108147Y, Sep. 3, 2008.
English-language machine translation of Chinese Patent No. CN201879037U, Jun. 29, 2011.
English-language machine translation of Chinese Patent No. CN202035656U, Nov. 16, 2011.
English-language machine translation of Chinese Patent No. CN202445413U, Sep. 26, 2012.
English-language machine translation of Chinese Patent No. CN203087991U, Jul. 31, 2013.
English-language machine translation of Chinese Patent No. CN204908398U, Dec. 30, 2015.
English-language machine translation of Chinese Patent No. CN205306253U, Jun. 15, 2016.
English-language machine translation of Chinese Patent No. CN206777019U, Dec. 22, 2017.
English-language machine translation of Chinese Patent No. CN207202448U, Apr. 10, 2018.
English-language machine translation of Chinese Patent No. CN208354901U, Jan. 11, 2019.

(56) References Cited

OTHER PUBLICATIONS

English-language machine translation of Chinese Patent No. CN212345713U, Jan. 15, 2021.
English-language machine translation of Chinese Patent No. CN2676714Y, Feb. 9, 2005.
English-language machine translation of Chinese Patent No. CN2790257Y, Jun. 28, 2006.
English-language machine translation of Chinese Patent No. CN2865402Y, Feb. 7, 2007.
English-language machine translation of Taiwan Patent Application No. TWM437102U, Sep. 11, 2012.
"Aonijie E908 Nylon Marathon Kettle Pack Outdoor Sports Wrist Storage Bag . . . ," Web page <https://www.aonijle.com/index.php/product/index/g/e/id/82.html> 1 page, Mar. 7, 2022.
"Platypus Big Zip EVO Reservoir Hanger," Web page <https://www.platy.com/platypus-accessories/big-zip-evo-reservoir-hanger/11006.html> 1 page, Mar. 7, 2022.
"Gregory Endo 15 3D-Hydro," Web page <https://www.gregorypacks.com/packs-bags/hydration-packs/endo-15-3d-hydro-91650XXXX.html> 1 page, Mar. 7, 2022.
"The Best Collapsible Water Bottles for Runners," Web page <https://www.runnersworld.com/gear/a26414940/collapsible-water-bottles/>, 1 page, Mar. 7, 2022.
"CamelBak Ultra Handheld Chill Review," <http://trallandultrarunning.com/camelbak-ultra-handheld-chill-review/>, 1 page, Mar. 7, 2022.

* cited by examiner

PERSONAL HYDRATION SYSTEMS

RELATED APPLICATION

This application claims priority to U.S. Provisional Patent Application No. 63/347,941, filed on Jun. 1, 2022, the complete disclosure of which is incorporated herein by reference.

FIELD

The present disclosure relates to personal hydration systems.

BACKGROUND

Personal hydration systems allow a user to drink more or less continuously or on demand while engaged in sporting, athletic, or other recreational activities. Personal hydration systems typically include a bag-like fluid reservoir that is carried in a backpack or a waist pack. A long flexible tube extends from the reservoir to a mouthpiece and permits a user to draw drink liquid from the reservoir as needed or otherwise as desired by the user.

SUMMARY

Personal hydration systems that comprise a reservoir assembly are disclosed. Reservoir assemblies comprise a flexible bladder that defines an internal compartment for holding a volume of drink liquid, a fill port assembly coupled to the flexible bladder and defining an opening to the internal compartment, and an exit port coupled to the flexible bladder. The fill port assembly is configured to selectively seal the opening, and the exit port defines a passage for delivering drink liquid from the internal compartment.

In some examples, the flexible bladder comprises a base opposite the opening, and the base extends generally perpendicular to a longitudinal axis of the flexible bladder in two dimensions.

In some examples, the flexible bladder has a front side wall, a rear side wall opposite the front side wall, a first edge side wall extending between the front side wall and the rear side wall, and a second edge side wall opposite the first edge side wall, and wherein the front side wall, the rear side wall, the first edge side wall, and the second edge side wall extend from the opening to the base, and wherein the exit port is coupled to one of the first edge side wall or the second edge side wall.

In some examples, the reservoir assembly further comprises an elongate flexible handle that is operatively coupled relative to the flexible bladder and the fill port assembly, and the elongate flexible handle and at least the flexible bladder collectively define a hand passage extending between the elongate flexible handle and the flexible bladder.

In some examples, the reservoir assembly further comprises a tab that is coupled to the base within the internal compartment, the opening is sized to permit a human hand to extend through the opening to reach the tab, the tab is configured to be engaged by the human hand, and the flexible bladder is sufficiently flexible to permit eversion of the flexible bladder responsive to the human hand engaging the tab and pulling the tab and the base through the opening.

DESCRIPTION

Figure 1:
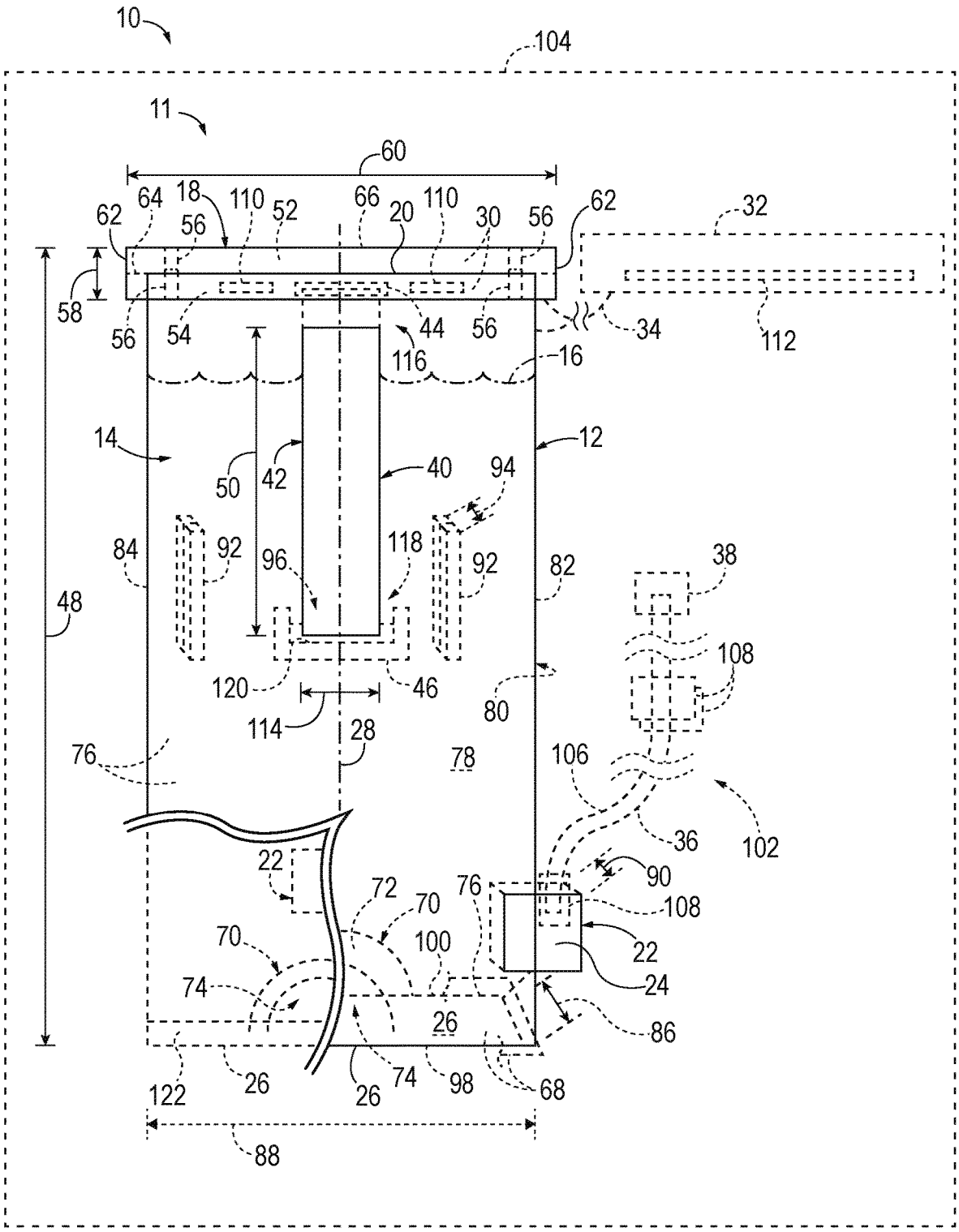
FIG. 1 is a schematic diagram representing examples of personal hydration systems according to the present disclosure.

Personal hydration systems 10 according to the present disclosure are schematically illustrated in FIG. 1. Generally, in FIG. 1, elements that are likely to be included in a given example are illustrated in solid lines, while elements that are optional to a given example or that correspond to one or more particular examples are illustrated in broken lines. However, elements that are illustrated in solid lines are not essential to all examples of the present disclosure, and an element shown in solid lines may be omitted from a particular example without departing from the scope of the present disclosure.

As schematically illustrated in FIG. 1, personal hydration systems 10 comprise at least a reservoir assembly 11 that comprises a flexible bladder 12, a fill port assembly 18 that is coupled to the flexible bladder 12, and an exit port 22 that is coupled to the flexible bladder 12 and that defines a passage 24 for delivering drink liquid 16 from the internal compartment 14. As schematically illustrated in dashed lines in FIG. 1, reservoir assemblies 11 further may include a downstream assembly 102 extending from the exit port 22 and fluidly coupled to the passage 24 thereof; however, a reservoir assembly 11 may be provided without a downstream assembly 102 but may be configured to be selectively coupled to and decoupled from a downstream assembly 102. Reservoir assemblies 11 may be designed to be used in conjunction with a backpack, a waist mounted pack (or lumbar pack), an article of clothing, or another body-worn device 104 to enable a user to consume drink liquid 16 while wearing the body-worn device 104 without having to first remove the body-worn device 104 or remove the reservoir assembly 11 from the body-worn device 104. A body-worn device 104 may be considered a component of a personal hydration system 10, and body-worn device 104 may be sized and/or otherwise configured to receive the reservoir assembly 11. For example, body-worn device 104 may include a pocket or chamber that is sized and/or shaped to receive and support at least the flexible bladder 12 of the reservoir assembly 11 when the flexible bladder 12 is filled with drink liquid 16, and the body-worn device 104 may include an opening sized to enable the downstream assembly 102 to extend therethrough and thus out of the body-worn device 104.

As schematically illustrated in FIG. 1, the flexible bladder 12 defines an internal compartment 14 configured and sized to hold, or contain, a volume of drink liquid 16 for selective consumption by a user through a downstream assembly 102. The downstream assembly 102 may be coupled to and extend from the exit port 22 and/or the downstream assembly 102 may be configured to be selectively coupled to and decoupled from the exit port 22. The downstream assembly 102, when present, may take any suitable form such that it defines a fluid conduit 106 through which drink liquid 16 may flow from the internal compartment 14, via the exit port 22. For example, and as schematically illustrated in FIG. 1, the downstream assembly 102 may include a plurality of fluidly interconnected components, such as including one or more of a length of an elongate drink tube 36 through which drink fluid 16 may flow, a mouthpiece 38, and one or more additional components 108, such as (but not limited to) an on/off valve, a quick connect assembly, a filter, and a gas mask fitting. It is within the scope of the present disclosure that an on/off valve, a quick connect assembly, and/or a combination of the two, when present, may be at least partially integral to the exit port 22, a mouthpiece 38, a filter, a gas mask fitting, and/or a length of the elongate drink tube 36. A mouthpiece 38 may take various forms, such as a bite-actuated mouthpiece, examples of which are disclosed in U.S. Pat. No. 6,764,064, the disclosure of which is incorporated herein by reference.

A predetermined maximum volume of drink liquid 16 held in the internal compartment 14 may be referred to as the capacity of the reservoir assembly 11. However, because the flexible bladder 12 is flexible, the internal compartment 14 may define various volumes depending on the volume of drink liquid currently being held in the internal compartment 14. As an example, when the internal compartment 14 is empty, or at least nearly empty, of drink liquid, the internal compartment 14 may effectively have zero, or at least near zero and/or a small, volume. When the internal compartment 14 does not contain drink liquid 16, and often when it only contains minimal drink liquid 16, the internal compartment 14 may have a volume that is less than 25%, less than 10%, less than 5%, or simply less than the volume of the internal compartment 14 when it contains its predetermined maximum volume of drink liquid.

Flexible bladders 12 may have any suitable shape, such as depending on a configuration of body-worn device 104, and may be formed from any suitable material or combinations of materials to hold up to the predetermined maximum volume, or capacity, of drink liquid 16. Examples of suitable capacities of internal compartment 14 include at least 24 fluid ounces (0.7 liters), at least 32 fluid ounces (0.9 liters), at least 50 fluid ounces (1.5 liters), at least 70 fluid ounces (2.1 liters), at least 100 fluid ounces (3.0 liters), at least 150 fluid ounces (4.4 liters), at least 200 fluid ounces (5.9 liters), more than 200 fluid ounces (5.9 liters), at most 104.8 fluid ounces (3.1 liters), at most 71 fluid ounces (2.1 liters), at most 54.1 fluid ounces (1.6 liters), 24-50 fluid ounces (0.7-1.5 liters), 50-80 fluid ounces (1.5-2.4 liters), 32-100 fluid ounces (0.9-3.0 liters), 100-150 fluid ounces (3.0-4.4 liters), and 100-200 fluid ounces (3.0-5.9 liters). Different capacities including capacities that are smaller than, larger than, or within these examples also are within the scope of the present disclosure.

Flexible bladders 12 may be constructed of a film or sheet material, such as a thermoplastic polyurethane (TPU). Other materials are also within the scope of the present disclosure, including materials that are configured to be resistant to chemical and/or biological agents, such as to mustard blister agent and/or sarin nerve agent. Some flexible bladders 12 may be constructed from two or more layers of one or more film or sheet materials. In embodiments that include two or more layers, one of the layers may be one or more of more durable, more insulating, more puncture resistant, and/or more UV resistant than one or more of the other layers.

As schematically illustrated in FIG. 1, the flexible bladder 12 and/or the fill port assembly 18 defines a fill port opening 20 to the internal compartment 14, and the fill port assembly 18 is configured to selectively seal the fill port opening 20. That is, the fill port opening 20 has a closed configuration, in which drink liquid 16 is restricted from passing through the fill port opening 20, and an open configuration or a range of open configurations, in which drink liquid 16 is permitted to pass through the fill port opening 20, such as to pour drink liquid 16 into or out of the internal compartment 14 via the fill port opening 20. Accordingly, the fill port assembly 18 is configured to selectively permit and restrict access to the internal compartment 14. Various types of fill ports are known in the art of personal hydration systems, including rigid fill ports, such as those that include threaded interfaces between the opening and a cap, and soft or deformable openings, such as those that include a clip or other device to selectively secure the opening in its closed configuration. The example reservoir assemblies 11 illustrated herein have deformable openings; however, various other features of the disclosed reservoir assemblies 11 may be used with other types and configurations of reservoir assemblies that do not have deformable openings. Examples of fill port assemblies with deformable openings are disclosed in U.S. Pat. No. 8,186,881, the disclosure of which is incorporated herein by reference. Examples of fill port assemblies with threaded interfaces are disclosed in U.S. Pat. Nos. 7,063,243 and 8,177,097, the disclosures of which are incorporated herein by reference.

With reference to FIG. 1, flexible bladders 12 may be described as comprising a base 26 that is opposite the fill port opening 20 and as defining a longitudinal axis 28 that extends between and through the fill port opening 20 and the base 26. Flexible bladders 12 may be constructed of one or more bladder panels 76. For example, two bladder panels 76 of similar size and shape may be joined together along their peripheries but for at the fill port opening 20 to define the internal compartment 14 of a flexible bladder 12. Alternatively, in other examples, a single bladder panel 76 may be joined to itself to define the internal compartment 14. Regardless of the number of bladder panels 76 utilized, a flexible bladder 12 may be described as having a front side wall 78, a rear side wall 80 opposite the front side wall 78 relative to the longitudinal axis 28, a first edge side wall 82 extending between the front side wall 78 and the rear side wall 80, and a second edge side wall 84 opposite the first edge side wall 82 relative to the longitudinal axis 28, and with the front side wall 78, the rear side wall 80, the first edge side wall 82, and the second edge side wall 84 each extending from the fill port opening 20 to the base 26. As used herein, a "wall" of a flexible bladder 12 may, but does not necessarily in all examples, correspond to a distinct bladder panel 76, and the "wall" may or may not have defined peripheries thereof. As such, a "wall" of the flexible bladder 12 may refer to general spatial regions of the flexible bladder 12, and the "wall" additionally or alternatively may be referred to as a wall region, a wall surface, a region, or a surface of the flexible bladder 12. Moreover, spatial terms, such as front, rear, top, bottom, above, below, upper, lower, and the like are used herein to describe relative positions of components and do not require that personal hydration systems 10 and reservoir assemblies 11 be positioned in a particular orientation, such as within a body-worn device 104. That said, generally, when a reservoir assembly 11 is in-use, the fill port assembly 18 will be positioned generally above the exit port 22, such that the fluid head of the drink liquid 16 causes it to be dispensed through the exit port 22 and into the downstream assembly 102.

Figure 12:
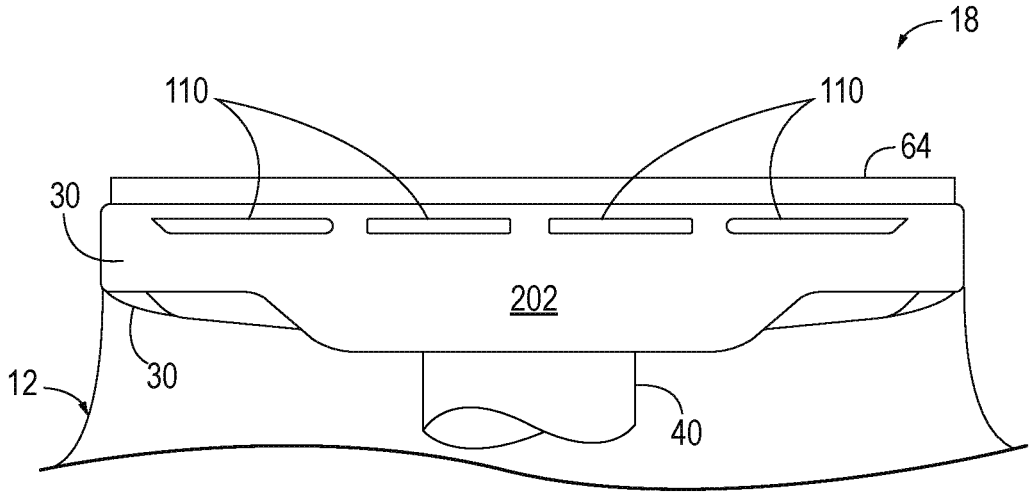
FIG. 12 is a partial fragmentary rear view of the portion of the reservoir assembly of FIG. 9, shown with the panels of the fill port assembly in the folded configuration.
Figure 13:
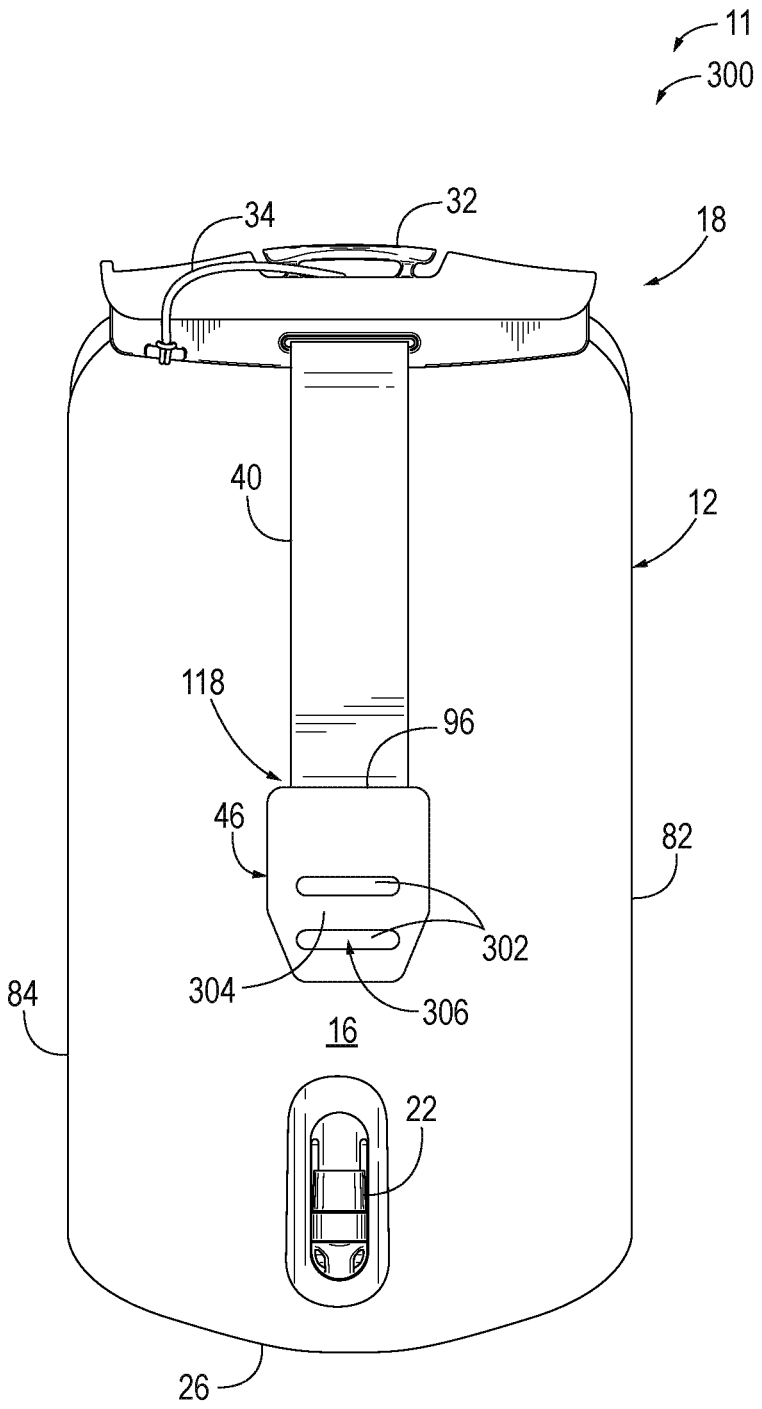
FIG. 13 is a front view of another example reservoir assembly according to the present disclosure.
Figure 14:
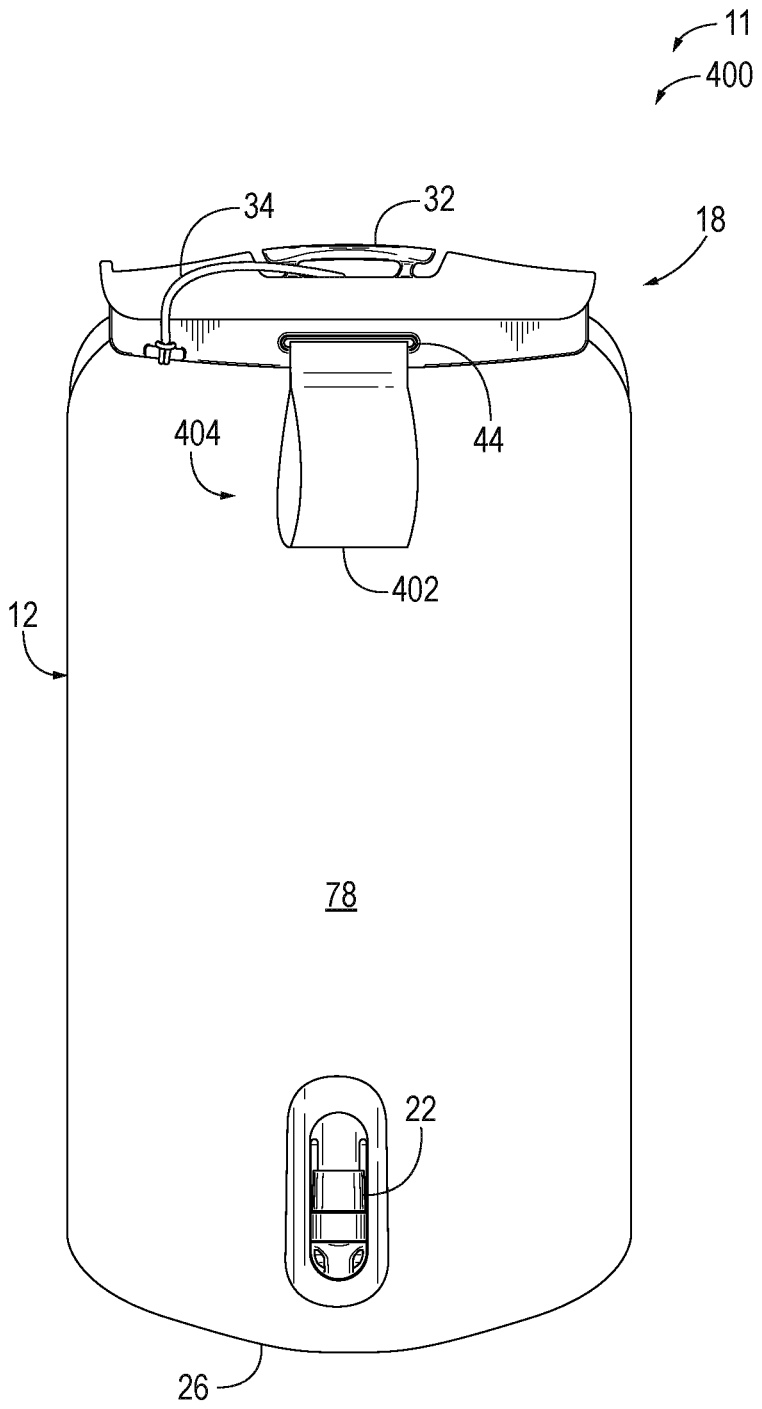
FIG. 14 is a front view of another example reservoir assembly according to the present disclosure.

As schematically illustrated in FIG. 1, in some examples, the exit port 22 is coupled to one of the first edge side wall 82 or the second edge side wall 84. Such examples may provide for a thinner overall profile of the reservoir assembly 11, may restrict the exit port 22 from uncomfortably poking a user through a body-worn device 104 or detrimentally poking and/or rubbing a body-worn device 104, and may restrict the exit port 22 from obstructing insertion of additional items against the front or rear wall of the flexible bladder 12 in a pack or other body-worn device 104. In other examples, and as schematically and optionally illustrated in dashed lines in the lower left corner of the reservoir assembly 11, the exit port 22 may be coupled to one of the front side wall 78 or the rear side wall 80. FIGS. 12-14 also provide an example of a reservoir assembly 11 with such an exit port 22.

As schematically illustrated in FIG. 1, in some examples, the flexible bladder 12 comprises one or more baffles 92 that extend between the front side wall 78 and the rear side wall 80 within the internal compartment 14 and that are configured to maintain the front side wall 78 and the rear side wall 80 within a threshold distance of each other. When present, the baffles 92 restrict the flexible bladder 14 from bulging toward a generally cylindrical shape when filled with drink liquid 16. Baffles 92 also generally restrict sloshing of drink liquid 16 within the internal compartment 14. As a result, the reservoir assembly 11 is confined to a desirable overall volume for operatively fitting within a body-worn device 104. In some examples and as schematically and optionally represented in FIG. 1, the one or more baffles 92 are configured to be selectively released (and thereafter selectively reattached) to permit the front side wall 78 and the rear side wall 80 to be spaced apart greater than the threshold distance, such as to facilitate cleaning of the internal compartment 14. Examples of suitable baffles and construction of flexible bladders 12 are disclosed in U.S. Pat. Nos. 9,833,057 and 10,051,946, and in U.S. Patent Application Publication No. 2017/0240319, the disclosures of which are incorporated herein by reference.

As schematically indicated in FIG. 1, the one or more baffles 92 may be described as having a baffle depth 94, and the exit port 22 may be described as having a maximum port depth 90, with depth being in a direction that is perpendicular to the longitudinal axis 28 and corresponding to a direction of separation between the front side wall 78 and the rear side wall 80. In some examples, the baffle depth 94 is greater than the maximum port depth 90. Accordingly, in such examples, and when the exit port 22 is coupled to one of the first edge side wall 82 or the second edge side wall 84, when the internal compartment 14 is filled with drink liquid and thus the front side wall 78 and the rear side wall 80 are at a maximum distance apart, the exit port 22 will be confined within a thin profile, or depth, of the flexible bladder 12. As a result, the exit port 22 may be restricted from poking a user through a user-worn device 104 and/or be restricted from poking away from a user or from poking and detrimentally wearing against a user-worn device 104.

As mentioned, reservoir assemblies 11 may be described as having soft or deformable openings 20. With continued reference to FIG. 1, in some examples, the fill port assembly 18 comprises one or more flexible and resilient fill port panels 30 that are coupled to the flexible bladder 12 adjacent to the fill port opening 20. When present, these flexible and resilient fill port panels 30 serve to bias the fill port opening 20 toward the closed configuration. Accordingly, to transition the fill port opening 20 into the range of open configurations, a user selectively pulls or otherwise urges apart opposed sides of the opening, and upon being released, the one or more flexible and resilient fill port panels 30 resiliently return the fill port opening 20 to the closed configuration. The flexible and resilient fill port panels 30 may be constructed of a material that is more rigid or stiffer than the flexible bladder 12. In some examples, the flexible and resilient fill port panels 30 may be constructed of the same material as the flexible bladder 12, such as TPU, but may be thicker than the walls of the flexible bladder 12 to provide the desirable resiliency to bias the fill port opening 20 toward the closed configuration.

In some examples, as schematically illustrated in FIG. 1, the fill port assembly 18 further comprises a slider 32 that is configured to selectively engage the one or more flexible and resilient fill port panels 30 to maintain the fill port opening 20 in the closed configuration and also to be selectively disengaged from the one or more flexible and resilient fill port panels 30 to permit the fill port opening 20 to be selectively transitioned into the range of open configurations. For example, the one or more flexible and resilient fill port panels 30 may comprise one or more projections 110, and the slider 32 may comprise or define a track 112 configured (i.e., sized and shaped) to receive the projections 110 in a sliding arrangement and thereby retain the slider 32 about the fill port opening 20 and restrict the fill port opening 20 from expanding from the closed configuration toward the range of open configurations. The slider 32 and the flexible and resilient fill port panels 30 may be described as having a friction-fit arrangement, such that the slider 32, when installed about the fill port opening 20, does not freely slide off of the flexible and resilient fill port panels 30, and a user-imparted force is required to translate the slider 32 off and on the flexible and resilient fill port panels 30.

In some examples, the fill port assembly 18 further comprises a tether 34 that is coupled between the slider 32 and the flexible bladder 12 or between the slider 32 and the fill port assembly 18, such as the one or more flexible and resilient fill port panels 30. Accordingly, when present, the tether 34 retains the slider 32 in a defined distance or proximity relative to the fill port opening 20 such that it is readily accessible by a user and is not separated or lost from the remainder of the reservoir assembly 11. The tether 34, when present, is sufficiently long enough to permit operative placement of the slider 32 relative to the fill port opening 20 for operative sliding of the slider 32 into place to retain the fill port opening 20 in the closed configuration.

In some examples, at least one flexible and resilient fill port panel 30 is configured to be folded relative to the flexible bladder 12 to configure the one or more flexible and resilient fill port panels 30 for operative engagement by the slider 32. In some examples, more than one flexible and resilient fill port panel 30 may be included, such as a first flexible and resilient fill port panel 52 coupled to the flexible bladder 12 on one side of the fill port opening 20 and a second flexible and resilient fill port panel 54 coupled to the flexible bladder 12 on another side of the fill port opening 20 opposite the first flexible and resilient fill port panel 52. In some such examples, the second flexible and resilient fill port panel 54 is stiffer than the first flexible and resilient fill port panel 52, although it is within the scope of the present disclosure that the fill port panels 30 may have the same stiffness or that the first flexible and resilient fill port panel 52 is stiffer than the second flexible and resilient fill port panel 54. It also is within the scope of the present disclosure that the flexible bladder 12 includes one or more flexible and resilient fill port panels 30 and one or more fill port panels that are not resiliently flexible.

In some examples, the one or more flexible and resilient fill port panels 30 may be described as having an unfolded configuration, in which the fill port opening 20 is permitted to transition toward the range of open configurations, and a folded configuration, in which the fill port opening 20 is in the closed configuration and is restricted from transitioning toward the range of open configurations. Accordingly, and as schematically represented in FIG. 1, the fill port assembly 18 may define a fold line 64, with at least one of the one or more flexible and resilient fill port panels 30 being positioned wholly on one side of the fold line 64. In other examples, a flexible and resilient fill port panel 30 itself may define a fold line 64, such that the flexible and resilient fill port panel 30 is configured to be folded relative to itself.

As schematically illustrated in FIG. 1, some reservoir assemblies 11 further comprise an elongate flexible handle 40 that is operatively coupled relative to the flexible bladder 12 and the fill port assembly 18. The elongate flexible handle 40 additionally or alternatively may be described as a hand strap 40. When present, the elongate flexible handle 40 and at least the flexible bladder 12 collectively define a hand passage 42 that extends between the elongate flexible handle 40 and the flexible bladder 12, such as one of the front side wall 78 or the rear side wall 80. In particular, the hand passage 42 is positioned adjacent to and/or overlapping with the fill port assembly 18. The hand passage 42 extends transverse to the longitudinal axis 28. For example, the elongate flexible handle 40 may extend parallel to the longitudinal axis 28 or generally parallel to the longitudinal axis 28, such as within 15 degrees of being parallel to the longitudinal axis 28. The hand passage 42 is sized for a human hand to extend at least partially, at least substantially, and/or completely through the hand passage 42.

Figure 2:
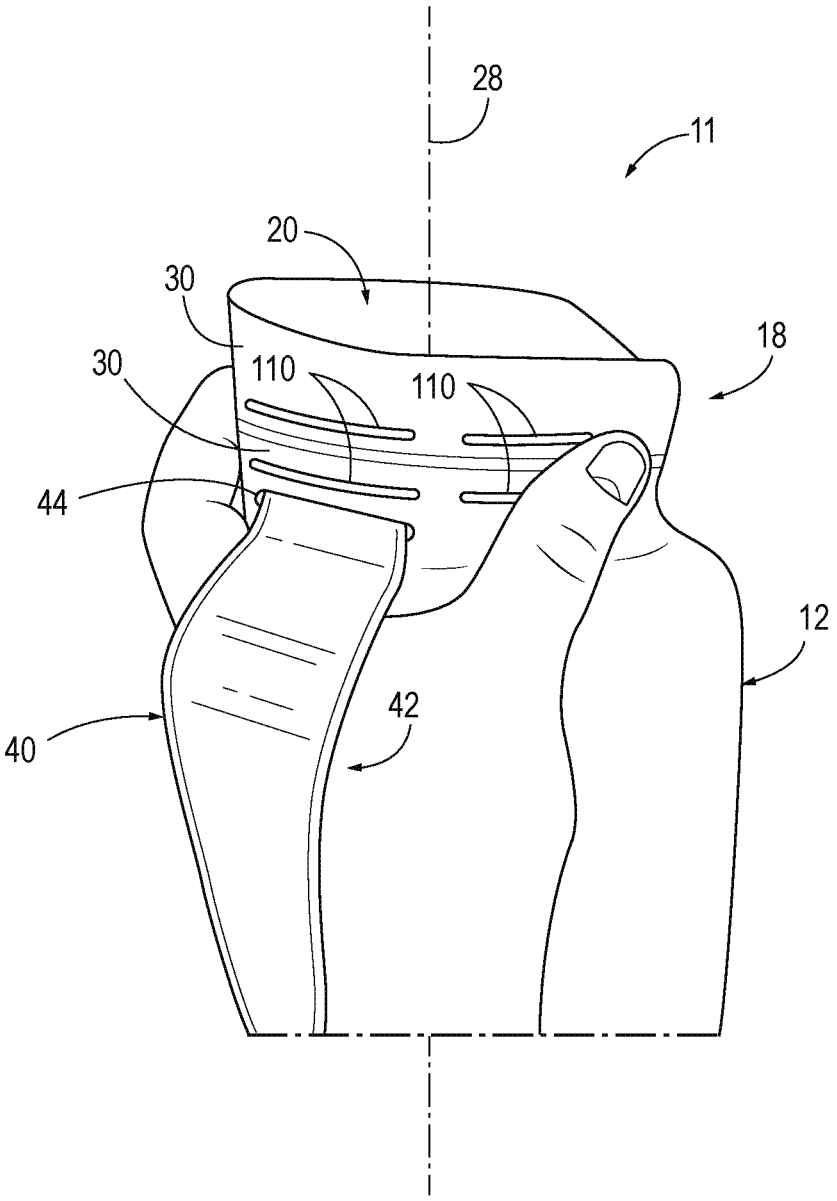
FIG. 2 is a partial perspective view of an example reservoir assembly of a personal hydration system according to the present disclosure, shown with a user having transitioned the opening to an open configuration.

As illustrated in FIG. 2, the hand passage 42 may be sized so that a user may extend their hand through the hand passage 42 and grasp the fill port assembly 18, such as illustrated in the example of FIG. 2, for selectively configuring the fill port opening 20 from the closed configuration into the range of open configurations for filling the internal compartment 14 with drink liquid 16 or for emptying the internal compartment 14 of drink liquid 16. In particular, as illustrated in the example of FIG. 2, a user's hand may be positioned such that their thumb engages the fill port assembly 18 on one lateral side region of the fill port opening 20 and one or more fingers engage the fill port assembly 18 on the opposite lateral side region of the fill port opening 20, with the user's palm (i.e., the palmar side of the user's hand) facing the flexible bladder 12, and the elongate flexible handle 40 extending against the dorsal side of the user's hand. For example, in examples that include one or more resilient and flexible fill port panels 30, the user's thumb and finger(s) may engage opposite end regions of one such resilient and flexible fill port panel 30, and by squeezing the fill port assembly 18, the user will draw the opposite lateral edge regions of the fill port opening 20 toward each other so that the fill port opening 20 transitions into the range of open configurations. Then, upon release of the squeezing force, the one or more resilient and flexible fill port panels 30 serve to bias the fill port opening 20 back toward the closed configuration. As illustrated in the example of FIG. 2, the elongate flexible handle 40 may conform to the shape of the portion of the dorsal side of the user's hand that extends into the hand passage 42 and is engaged by the elongate flexible handle 40. Additionally, a user may directly grasp the elongate handle 40 for carrying the reservoir assembly 11 and/or for operatively positioning the reservoir assembly 11 in a body-worn device 104 or selectively removing the reservoir assembly 11 from a body-worn device 104.

By "flexible," it is meant that the elongate flexible handle 40 generally or somewhat conforms to the shape of the structure over which it is positioned. For example, when the reservoir assembly 11 is positioned with its rear side wall 80 on a flat surface with the longitudinal axis 28 being generally horizontal, the elongate flexible handle 40 will generally lay flat and conform to the front side wall 78. When a user's hand is extending through the hand passage 42, the elongate flexible handle 40 generally conforms to the surface of the user's hand. The elongate flexible handle 40 is not constructed of a rigid, semi-rigid, and/or resilient plastic or other material that defines a specific shape, or fixed orientation, of the elongate resilient handle relative to the flexible bladder 12 and/or the fill port assembly 18, for example.

The elongate handle 40, when present, may take a variety of shapes and sizes. For example, the elongate flexible handle 40 may have a ribbon shape, that is, be generally thin and rectangular in shape, such as having a handle height 50 that is greater than a handle width 114 and that is significantly greater than a thickness of the handle. As a result, the elongate flexible handle 40, when not being used, will lay flat or at least substantially flat against the flexible bladder 12, will not take up significant space in a body-worn device 104, and will not poke a user or detrimentally poke or wear against the body-worn device 104. The elongate flexible handle 40 may be constructed of various materials. In some examples, the elongate flexible handle 40 may be constructed at least partially of a webbing material. In some examples, the elongate flexible handle 40 may be constructed at least partially of a fabric material, such as a woven fabric material. In some examples, the elongate flexible handle 40 is constructed of a plastic-coated fabric. In some examples, the elongate flexible handle 40 is constructed of a weldable material. As a more specific example, the elongate handle 40 may be constructed of a TPU-coated woven nylon webbing.

As mentioned, the elongate flexible handle 40 is operatively coupled relative to the flexible bladder 12 and the fill port assembly 18. In some examples, an upper end region 116 of the elongate flexible handle 40 is coupled directly, such as welded directly, to the flexible bladder 12 adjacent to the fill port assembly 18. In other examples, the upper end region 116 of the elongate flexible handle 40 is coupled directly, optionally welded directly, to the fill port assembly 18, such as to a flexible and resilient fill port panel 30 thereof. In some examples, the fill port assembly 18, such as a flexible and resilient fill port panel 30 thereof, defines a slot 44, and the elongate flexible handle 40 extends through the slot 44 and is secured to itself and optionally sewn or welded to itself. That is, the elongate flexible handle 40 may form a loop that extends through the slot 44 and is welded to itself, thereby retaining the elongate flexible handle 40 to the fill port assembly 18. In examples of reservoir assemblies 11 that include more than one flexible and resilient fill port panel 30, including a second flexible and resilient fill port panel 54 that is stiffer than a first flexible and resilient fill port panel 52, the stiffer second flexible and resilient fill port panel 54 may define the slot 44 through which the elongate flexible handle 40 extends. That is, in examples where one or two flexible and resilient fill port panels 30 are positioned on opposing sides of fill port opening 20 and one of the two flexible and resilient fill port panels is stiffer than the other, the stiffer one may be on the same side of the flexible bladder 12 as the elongate flexible handle 40. Accordingly, when a user extends their hand through the hand passage 42 to operatively transition the fill port opening 20 into the range of open configurations, it may be the stiffer of the two flexible and resilient fill port panels 30 that is engaged by the user's hand and squeezed.

A lower end region 118 of the elongate flexible handle 40 may be coupled directly or indirectly to the flexible bladder 12. In some examples, as schematically illustrated in FIG. 1, the reservoir assembly 11 further comprises a handle anchor 46 that is secured to the flexible bladder 12, and the elongate flexible handle 40 is secured to the handle anchor 46. That is, the handle anchor 46 may take any suitable form such that it is configured to operatively couple the elongate flexible handle 40 to, or relative to, the flexible bladder 12. In examples where the elongate flexible handle 40 is constructed of a weldable material, the handle anchor 46 also may be constructed of a weldable material, and the elongate flexible handle 40 may be welded to the handle anchor 46, and the handle anchor 46 may be welded to the flexible bladder 12. In some such examples, the handle anchor 46 is constructed of the same material as the elongate flexible handle 40, such as a TPU-coated woven nylon webbing. In some examples, the handle anchor 46 defines a pocket 96, into which the lower end region 118 of the elongate flexible handle 40 extends and within which the lower end region 118 is welded to the handle anchor 46. As a result, in such examples, the elongate flexible handle 40 is welded around an entire cross-section periphery of the lower end region 118 thereof, resulting in a secure coupling that is less prone to peeling or other unintentional detachment from the handle anchor 46 than if the lower end region 118 of the elongate flexible handle 40 were merely welded to an outer surface of the handle anchor 46 or to just the flexible bladder 12 itself via one side of the lower end region 118. In other examples, the handle anchor 46 may define a slot 120, through which the lower end region 118 of the elongate flexible handle 40 is looped and welded to itself or otherwise secured to itself, such as with stitching, a rivet, a snap, a hook-and-loop fastening mechanism, or at least one other mechanical fastener. Other configurations for operatively securing the elongate flexible handle 40 to the flexible bladder 12 also may be utilized without departing from the scope of the present disclosure.

By being "elongate," it is meant that the elongate flexible handle 40 has a handle height 50 that is longer than a handle width 114. In some examples, the handle height 50 may be between 10% and 60%, and optionally between 20% and 50%, and further optionally between 25% and 40% of an overall height 48 of the reservoir assembly 11. In some examples, the handle height 50 is sufficiently long to permit an average or typical sized human hand to fit sufficiently through the hand passage 42 that the elongate flexible handle 40 engages the dorsal side of the user's hand that extends into the hand passage 42. In some examples, the hand passage is sized to result in a snug fit when a user's hand is placed therethrough. By being snug, a user may have more control of the manipulation of the reservoir assembly 11 and in particular over the grasping and squeezing of the fill port assembly 18 to transition the fill port opening 20 into the range of open configurations. Examples of handle heights 50 and/or longitudinal spans of hand passages 42 include those in the ranges of 5-25 centimeters (cm), 10-20 cm, and 15-30 cm.

As discussed above, in some examples, the fill port assembly 18 comprises one or more flexible and resilient fill port panels 30 coupled to the flexible bladder 12 adjacent to the fill port opening 20. In some such examples, as schematically illustrated in FIG. 1, at least one flexible and resilient fill port panel 30 comprises one or more regions 56 of reduced thickness (e.g., in and out of the page in FIG. 1 and in a direction that is transverse or perpendicular to a plane defined by the corresponding flexible and resilient fill port panel 30). When present, these one or more regions 56 of reduced thickness may facilitate the fill port opening 20 transitioning from the closed configuration into the range of open configurations. More specifically, these one or more regions 56 of reduced thickness may act as a living, or integral, hinge within the corresponding flexible and resilient fill port panel 30. In particular, when present, a region 56 is located away from the longitudinal axis 28 and adjacent a lateral edge 62 of the fill port assembly 18, as schematically illustrated in FIG. 1. That is, a flexible and resilient fill port panel 30 comprising one or more regions 56 of reduced thickness may be described as having a respective panel width 60, and the one or more regions 56 may be positioned within 25%, within 20%, within 15%, or within 10% of the respective panel width 60 from a lateral edge 62 of the fill port assembly 18. As a result, and with reference to FIG. 2, the flexible and resilient fill port panel 30 having one or more regions 56 will operatively bulge outward adjacent to the region(s) 56. In examples that include two regions 56 on opposing end regions of the corresponding flexible and resilient fill port panel 30, the flexible and resilient fill port panel 30 will bulge outward between the two regions and thereby increase the cross-sectional area of the fill port opening 20 when a user squeezes the fill port assembly 18 to open the fill port opening 20. A flexible and resilient fill port panel 30 comprising one or more regions 56 additionally or alternatively may be described as requiring less force to configure the fill port assembly 18 so that the fill port opening 20 transitions more easily into the range of open configurations than an otherwise identical fill port assembly 30 with a flexible and resilient fill port panel 30 that does not include any regions 56.

In some examples, as schematically illustrated in FIG. 1, a flexible and resilient fill port panel 30 comprising region(s) 56 of reduced thickness may be described as having a respective panel height 58, and the region(s) 56 of reduced thickness may not span an entirety of the respective panel height 58. That is, a region 56 of reduced thickness may define a channel that is open at one edge of the respective flexible and resilient fill port panel 30 and that is closed, or that terminates, within an inner region of the respective flexible and resilient fill port panel 30. For example, the one or more regions 56 may span at least 25%, at least 30%, at least 40%, at least 50%, at least 60%, at most 90%, at most 80%, at most 70%, at most 60%, and/or at most 50% of the panel height 58. In some examples, the region(s) 56 of reduced thickness are linear and parallel, or generally linear and generally parallel, to the longitudinal axis 28.

As discussed herein, in some reservoir assemblies 11, the flexible and resilient fill port panel(s) 30 may have an unfolded configuration, in which the fill port opening 20 is permitted to transition toward the range of open configurations, and a folded configuration, in which the fill port opening 20 is in the closed configuration and is restricted from transitioning toward the range of open configurations. In some such examples, a distal edge 66 of the flexible and resilient panel 30 that comprises region(s) 56 of reduced thickness may be further away from the base 26 when the flexible and resilient fill port panel(s) 30 are in the unfolded configuration than when in the folded configuration. In other words, a flexible and resilient fill port panel 30 that comprises region(s) 56 may be positioned further away from the base 26 in the unfolded configuration than in the folded configuration. Moreover, such a flexible and resilient fill port panel 30 may be engaged with the flexible bladder 12 or with another resilient and flexible fill port panel 30 when in the folded configuration but not when in the unfolded configuration. In examples in which the fill port assembly 18 comprises a fold line 64, the resilient and flexible fill port panel 30 that comprises region(s) 56 of reduced thickness may be positioned wholly on one side of the fold line 64. In examples where a second flexible and resilient fill port panel 54 is stiffer than a first flexible and resilient fill port panel 52, the first flexible and resilient fill port panel 52 may comprise the region(s) 56 of reduced thickness. Moreover, the second flexible and resilient fill port panel 54 may not include any region(s) 56 of reduced thickness. In some examples, the flexible and resilient fill port panel(s) 30 that comprise region(s) 56 of reduced thickness may be integral and/or monolithic in construction, such as formed of a single piece of TPU material that is thicker than the film or sheet material of the flexible bladder 12.

With continued reference to FIG. 1, as schematically and optionally illustrated in the lower left corner of reservoir assemblies 11, in some examples, the base 26 may be described as being formed by the edges of the front side wall 78 and the rear side wall 80, such as formed by a pinch weld 122 between the front side wall 78 and the rear side wall 80. In other examples, however, as schematically and optionally illustrated in the lower right corner of the reservoir assemblies 11 in FIG. 1, the base 26 may include an additional component, surface, or other structure that is secured to both the front side wall 78 and the rear side wall 80 and that extends between these walls, such as generally perpendicular to the longitudinal axis 28. In some such examples, the base 26 may be described as a generally flat base, at least when the flexible bladder 12 holds a volume of drink liquid 16. In some examples, a front-side lower edge 98 of the front side wall 78 and a rear-side lower edge 100 of the rear side wall 80 may be spaced apart by the base 26, and in such examples, the base 26 additionally or alternatively may be referred to as a two-dimensional base 26 or a three-dimensional base 26, depending on whether the base includes a depth in addition to a length and a width that are distinct from the lower regions of the front side wall 78 and the rear side wall 80 that are secured to the base 26. In such examples of reservoir assemblies 11 having a two- or three-dimensional base 26, the internal compartment 14 may be easier to dry because the inside surfaces of the front side wall 78 and the rear side wall 80 are spaced apart from each other, at least in the lower regions thereof, by the base 26. In examples of reservoir assemblies 11 in which the exit port 22 is coupled to one of the front side wall 78 or the rear side wall 80, the base 26 may serve to restrict or prevent an interface between the exit port 22 and the flexible bladder 12 from being damaged. For example, the base 26 may be described as having a maximum base depth 86 and a maximum base width 88 that is transverse to the maximum base depth 86, and the maximum base depth 86 may be greater than the maximum port depth 90. As a result, when the internal compartment 14 is emptied of drink liquid 16 and the reservoir assembly is being stored, the flexible bladder will not lay completely flat, which otherwise could wear on the interface between the exit port 22 and the flexible bladder.

Such a two- or three-dimensional base 26 may be constructed in various manners. For example, the base 26 may be constructed of a distinct sheet of material from a remainder of the flexible bladder 12, and the base 26 may be welded and/or otherwise secured to the remainder of the flexible bladder 12. In some such examples, the flexible bladder 12 may be thicker at an interface between the base 26 and the adjacent regions of the flexible bladder 12, such as along the front-side lower edge 98 and the rear-side lower edge 100. In such examples, the thicker regions serve to define and maintain the shape of the base 26. In some examples, the base 26 may be thicker and/or stiffer than the front side wall 78 and the rear side wall 80. In some examples, the reservoir assembly may comprise a base frame 68 that is stiffer than the flexible bladder 12 and that is coupled to the flexible bladder to define the base 26. That is, an optional base frame 68 may define an interface between the base 26 and adjacent regions of the flexible bladder 12, with the optional base frame 68 being constructed of a distinct structure, such as TPU, that is thicker than the front side panel 78, the rear side panel 80, and/or the base 26. Other configurations of two- or three-dimensional bases 26 also are within the scope of the present disclosure, including pleated or folded bases that are configured to generally lay flat when the internal compartment 14 is empty of drink liquid 16 and that are configured to generally expand when the internal compartment 14 is holding a volume of drink liquid 16. Additional examples of suitable bases 26 are disclosed in U.S. Pat. Nos. 9,833,057 and 10,051,946, and in U.S. Patent Application Publication No. 2017/0240319, the disclosures of which are incorporated herein by reference.

With continued reference to the lower region of the schematically represented reservoir assemblies 11 of FIG. 1, some reservoir assemblies 11 further comprise a tab 70 that is coupled, optionally welded, to the base 26 within the internal compartment 14 and configured to be engaged, or grasped, by a human hand that is extended into the internal compartment 14 from the fill port opening 20. Accordingly, in such examples, the fill port opening 20 is sized to permit a human hand to extend through the fill port opening 20 to be able to operatively engage the tab 70.

Figure 3:
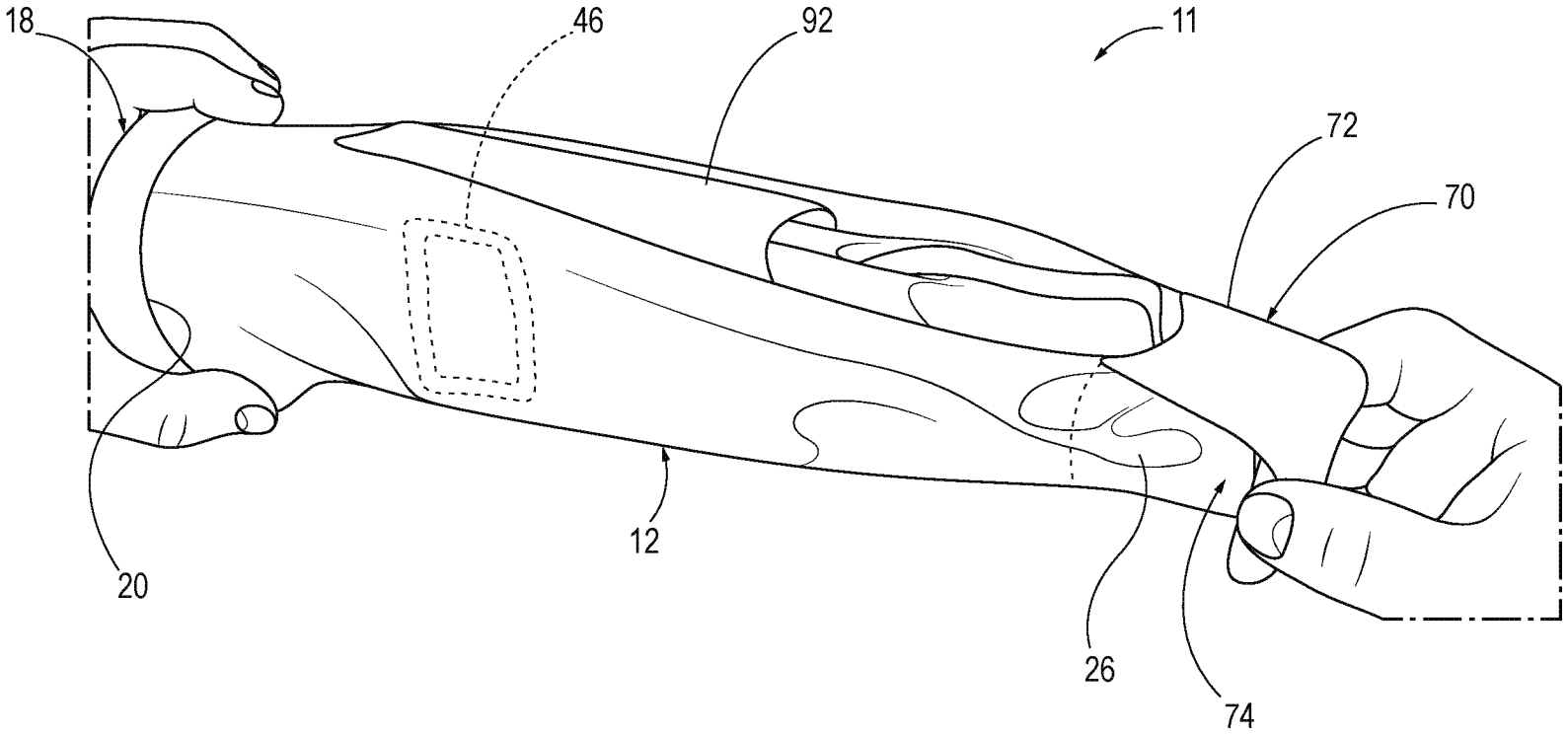
FIG. 3 is a perspective view of an example reservoir assembly of a personal hydration system according to the present disclosure, shown with a user having transitioned the reservoir assembly to an everted configuration.
Figure 4:
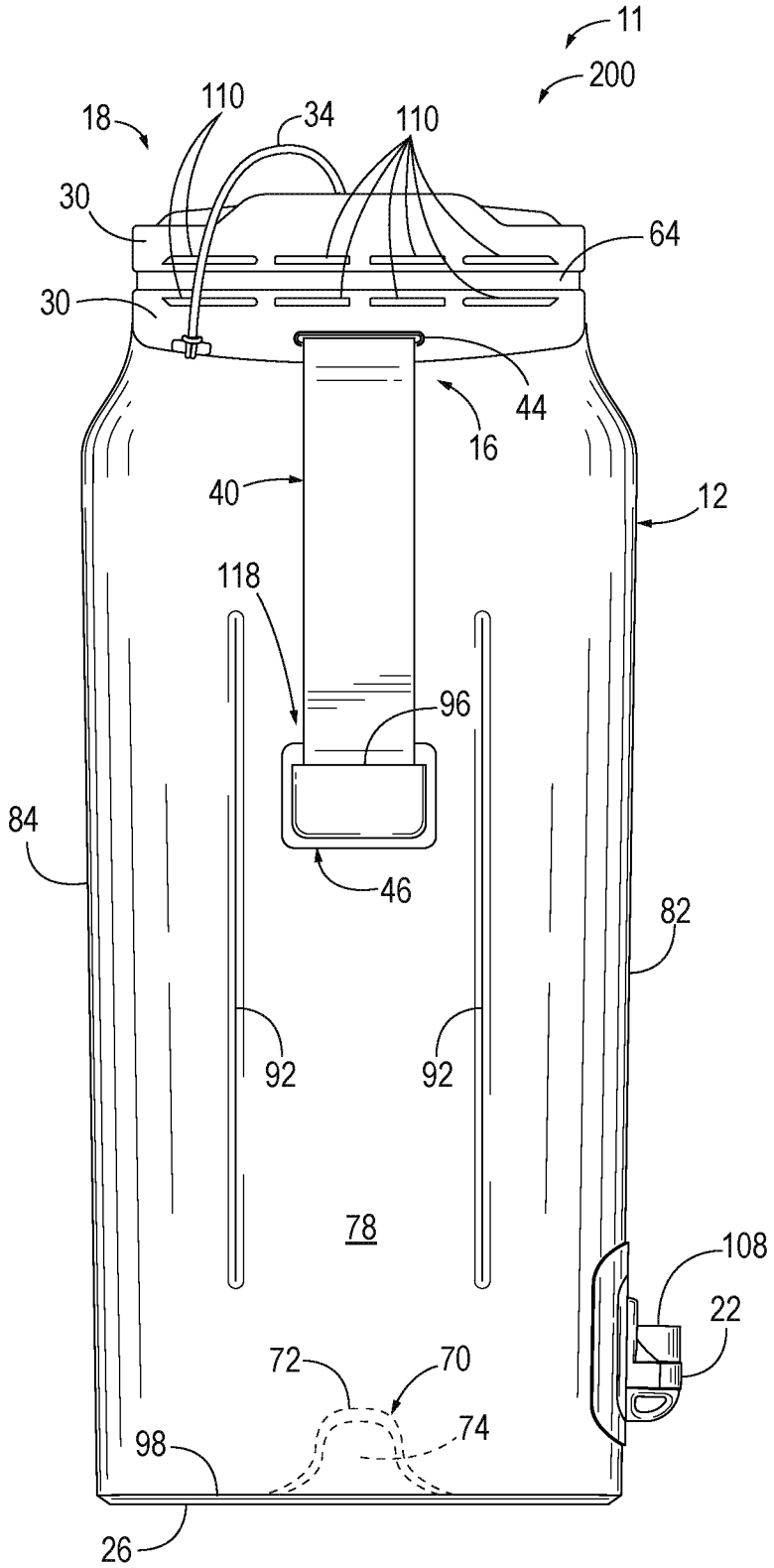
FIG. 4 is a front view of an example reservoir assembly according to the present disclosure.
Figure 5:
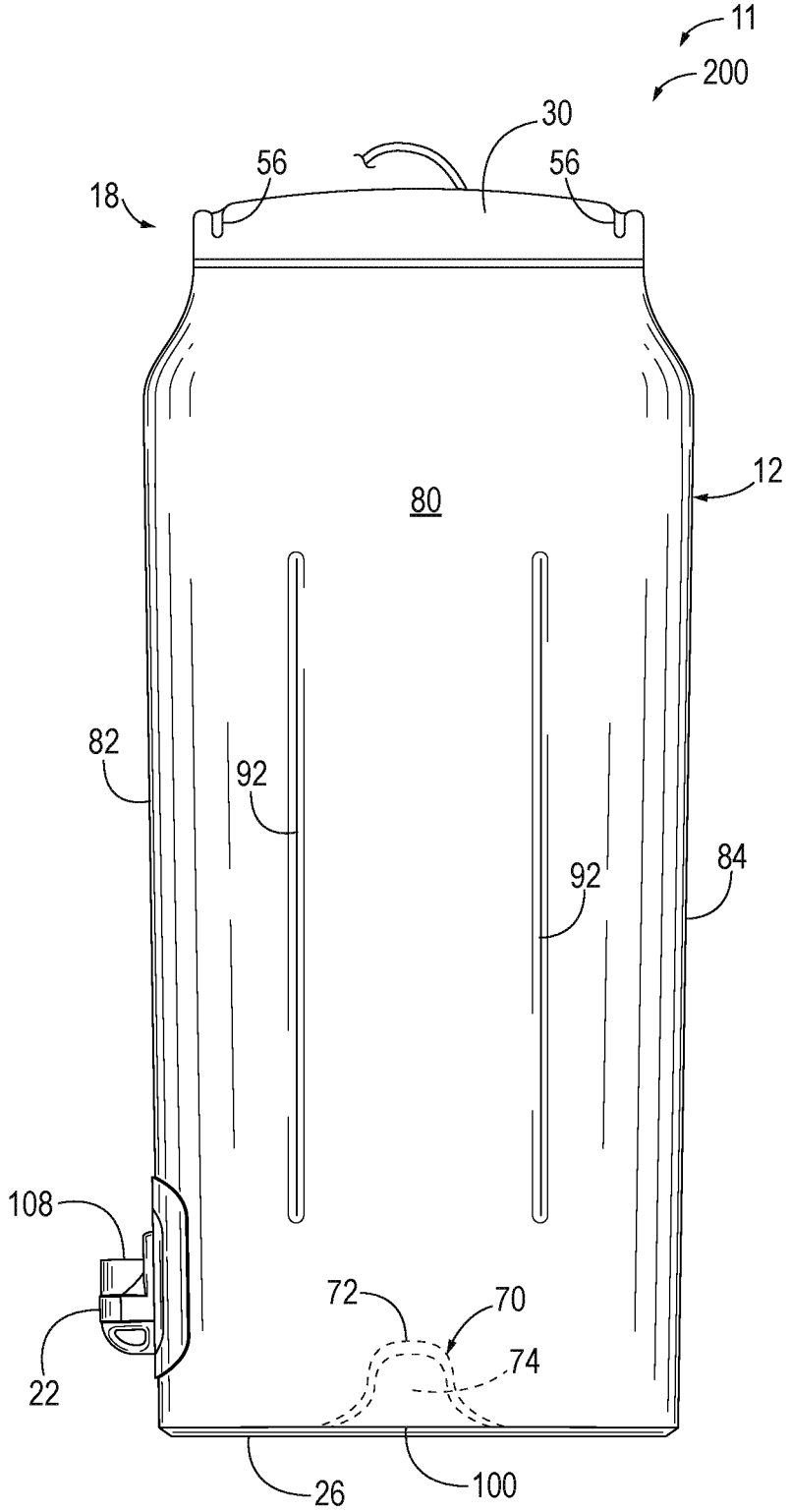
FIG. 5 is a rear view of the reservoir assembly of FIG. 4.
Figure 6:
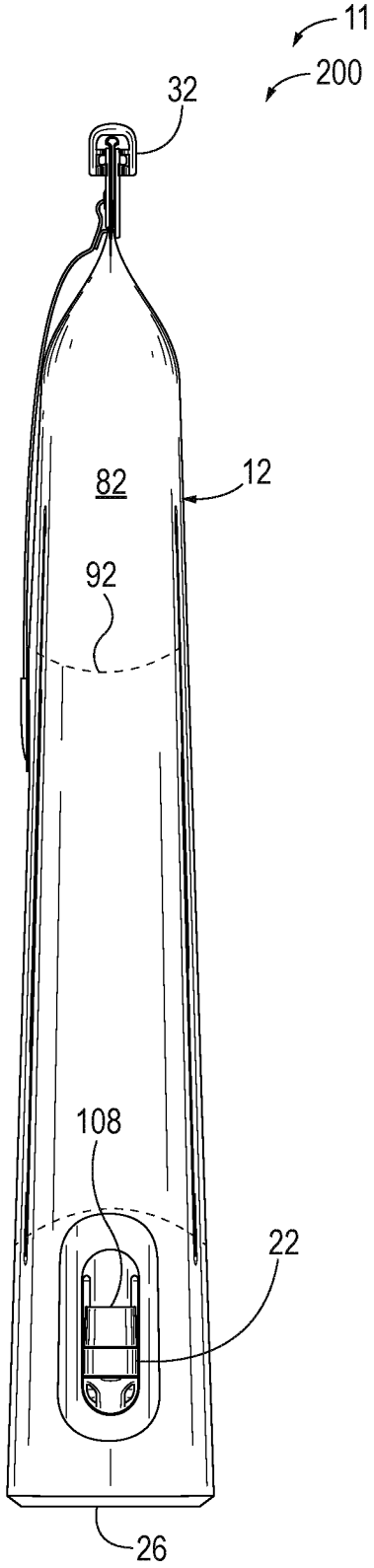
FIG. 6 is a side view of the reservoir assembly of FIG. 4.
Figure 7:
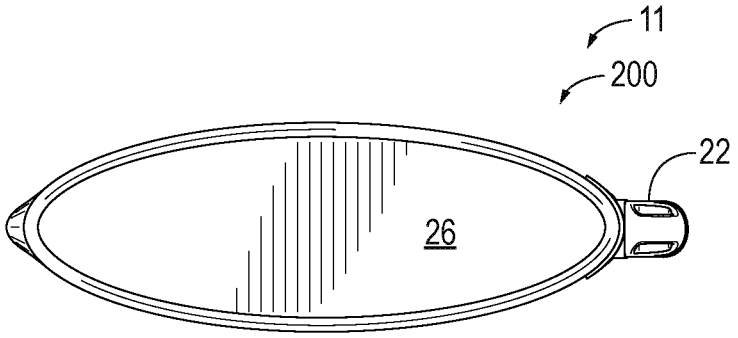
FIG. 7 is a bottom view of the reservoir assembly of FIG. 4.
Figure 8:
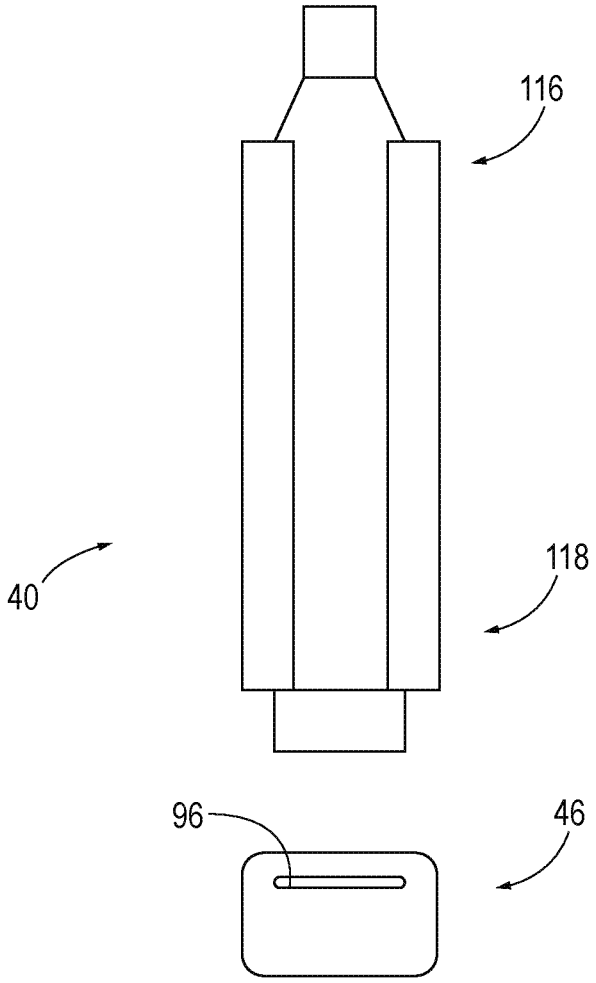
FIG. 8 is an unassembled exploded view of the handle of the reservoir assembly of FIG. 4.

Moreover, in such examples, the flexible bladder 12 is sufficiently flexible to permit eversion of the flexible bladder 12 responsive to the human hand engaging the tab 70 and pulling the tab 70 and the base 26 of the flexible bladder 12 through the fill port opening 20, such as illustrated in the example of FIG. 3. Such reservoir assemblies 11 therefore may be described as having a nominal, or operative, configuration, in which the internal compartment 14 is capable of holding drink liquid 16, and an everted configuration (FIG. 3), in which the tab 70 and the base 26 have been pulled though the fill port opening 20 such that the inside surfaces of the flexible bladder 12 that define the internal compartment 14 when in the nominal configuration, or at least a substantial portion thereof, are instead facing outward. That is, the optional tab 70 is utilized to turn the flexible bladder substantially inside-out for cleaning and/or drying the internal compartment 14. The optional tab 70 also may be referred to as a pull tab, a pull, a grab, an everting tab, a handle, a loop, and/or a finger loop.

As schematically illustrated in the optional representation in the lower left corner of reservoir assemblies 11 in FIG. 1, in some examples, the tab 70 may be secured to the flexible bladder 12 by being sandwiched between the front side wall 78 and the rear side wall 80 within a pinch weld 122. In other examples, such as schematically and optionally illustrated in the optional representation in the lower right corner of the reservoir assemblies 11 of FIG. 1, the tab 70 may be coupled, such as welded, directly to a two- or three-dimensional base 26. Alternatively, in some examples, a tab 70 may be molded integrally with the base 26.

In some examples, the tab 70 may be described as a ribbon 72 or having a ribbon shape or configuration, with the ribbon 72 being coupled to the base 26 at terminal ends of the ribbon 72, and thereby defining a finger passage 74 that is sized to receive at least one finger of a human hand therethrough. That is, rather than having to grasp a tab between two fingers or a finger and a thumb, a user may need to merely hook a finger or thumb through the finger passage 74 to engage and pull the tab 70 and the base 26 out through the fill port opening 20. In some such examples, the ribbon 72 is sufficiently stiff to maintain opposed sides of the flexible bladder 12 that are adjacent to the ribbon 72 (e.g., the front side wall 78 and the rear side wall 80) in a spaced-apart arrangement when the internal compartment is void of drink liquid 16. As a result, in such examples, the tab 70 serves to restrict the side walls from collapsing together during use. This may ensure that drink liquid 16 is permitted to easily flow to the exit port 22. Accordingly, in such examples, the tab 70 may extend above the base 26 a distance that is at least the same as or greater than the position of the exit port 22 relative to the base 26. In some examples, tab 70 is formed from the same material as flexible bladder 12, while in other examples, the tab 70 is formed from a different material. In some examples, the tab 70 is formed from the same thickness of material as the flexible bladder 12, while in other examples, the tab 70 is formed from a thicker or a thinner material than the flexible bladder 12. In some examples, the tab 70 is formed from a resilient material that has a defined nominal shape, such as in which the region of the tab distal its ends (e.g., the center or middle of the tab 70) projects further away from the base 26 of the flexible bladder 12 than the rest of the tab 70. In some embodiments, at least the region of the tab distal the ends of the tab 70 (e.g., the center or middle of the tab 70) has a width that is selected to urge the walls of the flexible bladder 12 away from each other when the flexible bladder 12 is empty or at least substantially empty of drink liquid. For example, at least this region, and optionally all of, the tab 70 may have a width (measured between opposed walls of the flexible bladder 70 that selectively engage this region of the tab 70) of at least 1 centimeter (cm), at least 2 cm, at least 3 cm, at least 4 cm, at most 10 cm, at most 8 cm, at most 6 cm, at most 5 cm, and/or at most 4 cm.

Turning now to FIGS. 4-15, illustrative non-exclusive examples of reservoir assemblies 11 and component parts thereof are illustrated. Where appropriate, the reference numerals from the schematic illustration of FIG. 1 are used to designate corresponding parts of the example reservoir assemblies 11; however, the examples of FIGS. 4-15 are non-exclusive and do not limit reservoir assemblies 11 and personal hydration systems 10 to the illustrated examples of FIGS. 3-14. That is, reservoir assemblies 11 and personal hydration systems 10 are not limited to the specific examples of FIGS. 4-15, and reservoir assemblies 11 and personal hydration systems 10 may incorporate any number of the various aspects, configurations, characteristics, properties, etc. of reservoir assemblies 11 and personal hydration systems 10 that are illustrated in and discussed with reference to the schematic representations of FIG. 1 and/or the examples of FIGS. 4-15, as well as variations thereof, without requiring the inclusion of all such aspects, configurations, characteristics, properties, etc. Moreover, features, materials, dimensions, etc. of the reservoir assemblies 11 of any of FIGS. 4-15 are illustrative, non-exclusive examples and optionally may be used with any of the other reservoir assembles 11 disclosed, incorporated, and/or illustrated herein. For the purpose of brevity, each previously discussed component, part, portion, aspect, region, etc. or variants thereof may not be discussed, illustrated, and/or labeled again with respect to the examples of FIGS. 4-15; however, it is within the scope of the present disclosure that the previously discussed features, variants, etc. may be utilized with any of the reservoir assemblies 11 of FIGS. 4-15.

A first example reservoir assembly 11 is illustrated in FIGS. 4-12 and referred to herein as reservoir assembly 200. As shown, reservoir assembly 200 is an example of a reservoir assembly 11 that comprises an exit port 22 that is coupled to the first edge side wall 82 of the flexible bladder 12, a pair of baffles 92, a two- or three-dimensional base 26, a tab 70 in the form of a ribbon 72 that is coupled to the inside surface of the base 26 and that defines a finger passage 74, a deformable fill port assembly 18 that comprises three resilient and flexible fill port panels 30 and a tethered slider 32, an elongate flexible handle 40, and a handle anchor 46. One of the three resilient and flexible fill port panels 30 defines a slot 44.

In particular, the elongate flexible handle 40 and the handle anchor 46 of reservoir assembly 200 are constructed of a weldable TPU-coated woven nylon webbing material. The upper end region 116 of the elongate flexible handle 40 extends through the slot 44 and is welded to itself to secure the elongate flexible handle 40 to the fill port assembly 18. The handle anchor 46 also is welded to the flexible bladder 12 and defines a pocket 96, into which the lower end region 118 of the elongate flexible handle 40 extends and is welded.

Figure 9:
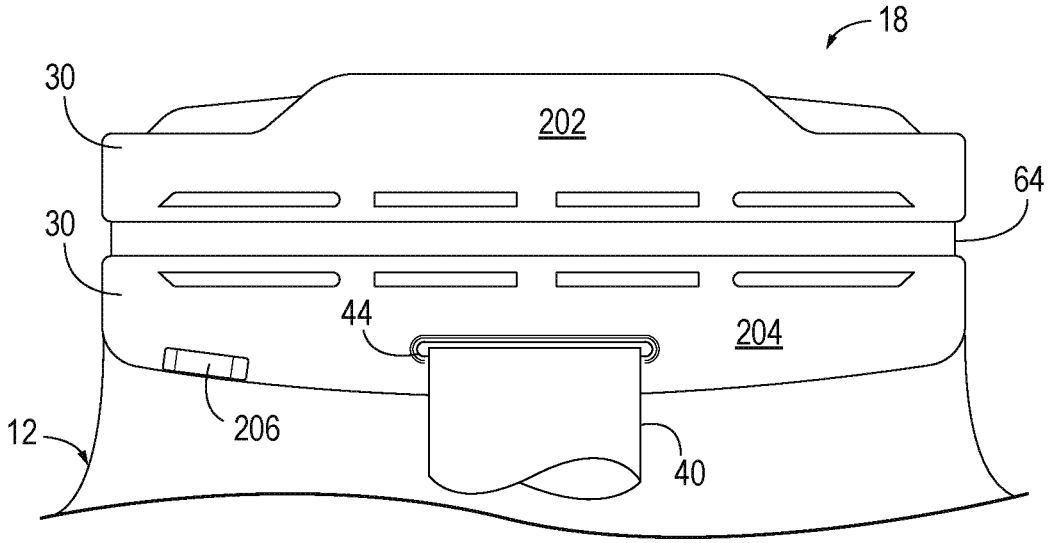
FIG. 9 is a front view of a portion of the reservoir assembly of FIG. 4, shown with the panels of the fill port assembly in the unfolded configuration.
Figure 10:
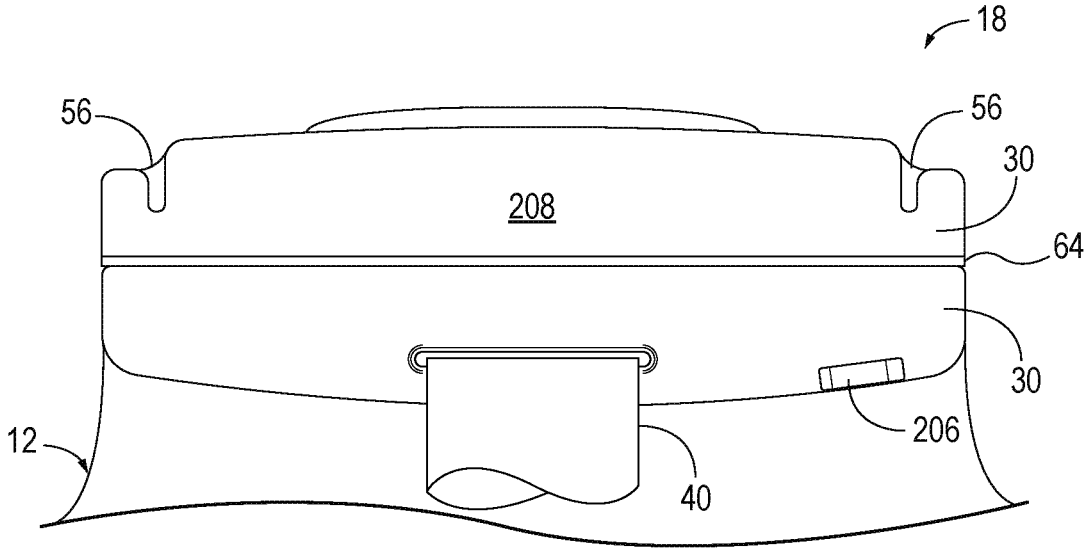
FIG. 10 is a partial fragmentary rear view of the portion of the reservoir assembly of FIG. 9, shown with the panels of the fill port assembly in the unfolded configuration.
Figure 11:
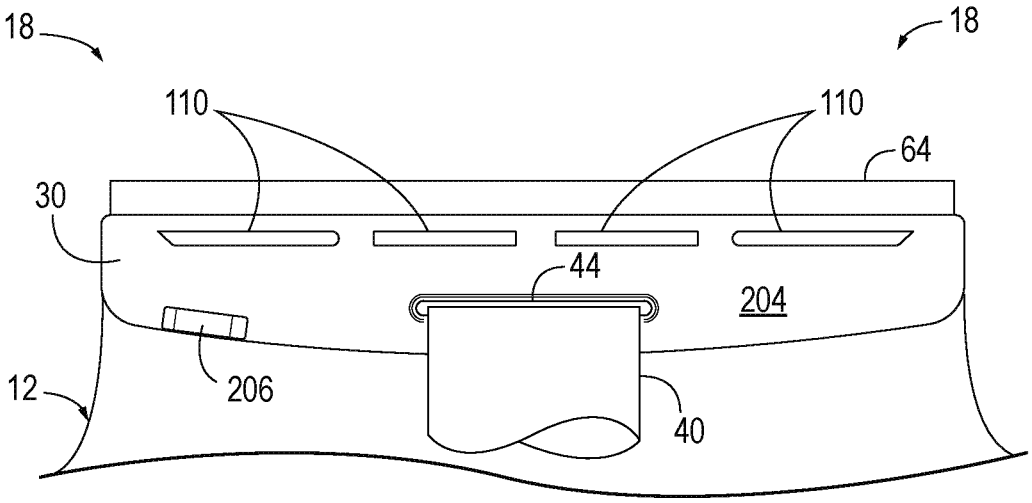
FIG. 11 is a partial fragmentary front view of the portion of the reservoir assembly of FIG. 9, shown with the panels of the fill port assembly in the folded configuration.

As illustrated in FIGS. 9-12, the fill port assembly 18 of reservoir assembly 200 is one that comprises a fold line 64, with the three flexible and resilient fill port panels 30 having a folded configuration (shown in FIGS. 11 and 12) and an unfolded configuration (shown in FIGS. 9 and 10). Two of the flexible and resilient fill port panels 30 are positioned opposite each other relative to the fold line 64 but on the same side of the fill port opening 20, with these flexible and resilient fill port panels 30 optionally being described as an upper outer fill port panel 202 and a lower outer fill port panel 204. In particular, when in the folded configuration (FIGS. 11 and 12), the upper outer fill port panel 202 and the lower outer fill port panel 204 are positioned on opposite sides of the flexible bladder 12. When in the unfolded configuration (FIGS. 9 and 10), the upper outer fill port panel 202 is positioned above (i.e., distal the base 26), but on the same side of the flexible bladder as, the lower outer fill port panel 204. The upper outer fill port panel 202 and the lower outer fill port panel 204 each comprise four elongate projections 110 that are configured to engage and mate with the slider 32. The lower outer fill port panel 204 defines the slot 44, through which the elongate flexible handle 40 extends. The lower outer fill port panel 204 also defines a tether passage 206, to which the tether 34 is secured. The third flexible and resilient fill port panel 30 may be described as an inner fill port panel 208 and is positioned on an opposite side of the fill port opening 20 from the upper outer fill port panel 202. The inner fill port panel 208 is an example of a flexible and resilient fill port panel 30 that comprises two regions 56 of reduced thickness extending from the distal edge 66 of the inner fill port panel 208 and adjacent the lateral edges 62 thereof.

A second example reservoir assembly 11 is illustrated in FIG. 13 and referred to herein as reservoir assembly 300. As shown, reservoir assembly 300 is an example of a reservoir assembly 11 that comprises an exit port 22 that is coupled to the front side wall 78 of the flexible bladder 12, a base 26 formed by the lower edges of the front side wall 78 and the rear side wall 80 being secured together, a deformable fill port assembly 18 including a tethered slider 32, an elongate flexible handle 40, and a handle anchor 46. The fill port assembly 18 and the elongate flexible handle 40 of reservoir assembly 300 are identical to the fill port assembly 18 and elongate flexible handle 40 of reservoir assembly 200 of FIGS. 4-12. The handle anchor 46, in addition to including a pocket 96 into which the lower end region 118 of the elongate flexible handle 40 extends and is welded, also includes two webbing slots 302 with a bridge 304 between the two webbing slots. The bridge 304 is not welded directly to the flexible bladder 12, and thereby defines a webbing passage 306, through which webbing may be selectively positioned by a user, such as to secure the reservoir assembly 300 to a body-worn device 104.

A third example reservoir assembly 11 is illustrated in FIG. 14 and referred to herein as reservoir assembly 400. As shown, reservoir assembly 400 is an example of a reservoir assembly 11 that comprises an exit port 22 that is coupled to the front side wall 78 of the flexible bladder 12, a base 26 formed by the lower edges of the front side wall 78 and the rear side wall 80 being secured together, and a deformable fill port assembly 18 that comprises a tethered slider 32. The fill port assembly 18 of reservoir assembly 400 is identical to the fill port assembly 18 of reservoir assemblies 200 and 300 of FIGS. 4-13. However, rather than having an elongate flexible handle 40, reservoir assembly 400 comprises a handle 402 that is constructed of a TPU-coated nylon webbing material that extends through the slot 44 of the lower outer fill port panel 204 and that is welded to itself to define a loop 404. The handle 402 and the loop 404 are sized so that a user may extend one to three fingers through the loop 404 to grasp the handle 402.

Figure 15:
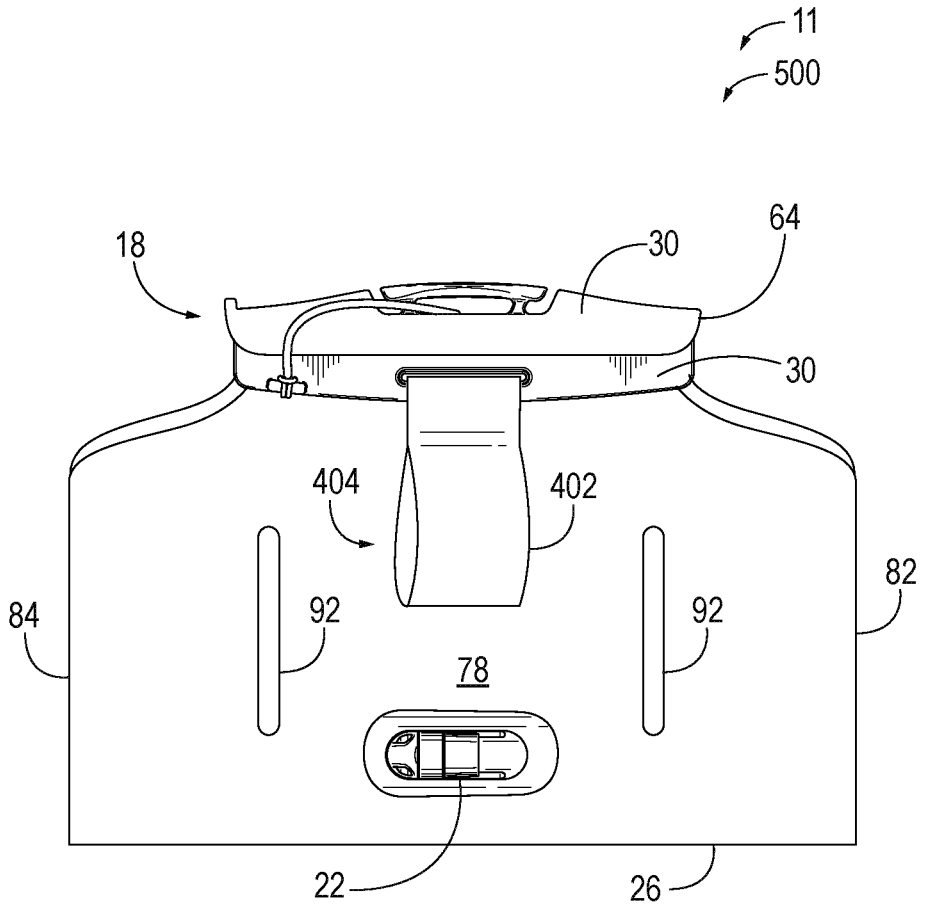
FIG. 15 is a front view of another example reservoir assembly according to the present disclosure.

A fourth example reservoir assembly 11 is illustrated in FIG. 15 and referred to herein as reservoir assembly 500. As shown, reservoir assembly 500 is an example of a reservoir assembly 11 that comprises an exit port 22 that is coupled to the front side wall 78 of the flexible bladder 12, a pair of baffles 92, a two- or three-dimensional base 26, a deformable fill port assembly 18 identical to the fill port assembly 18 of reservoir assemblies 200, 300, and 400 of FIGS. 4-14, and a handle 402. The flexible bladder 12 of reservoir assembly 500 is sized and shaped for a lumbar pack.

Illustrative, non-exclusive examples of inventive subject matter according to the present disclosure are described in the following enumerated paragraphs:

A. A personal hydration system (10), comprising a reservoir assembly (11), the reservoir assembly (11) comprising:

a flexible bladder (12) that defines an internal compartment (14) for holding a volume of drink liquid (16);

a fill port assembly (18) coupled to the flexible bladder (12) and defining an opening (20) to the internal compartment (14), wherein the fill port assembly (18) is configured to selectively seal the opening (20); and an exit port (22) coupled to the flexible bladder (12), wherein the exit port (22) defines a passage (24) for delivering drink liquid from the internal compartment (14).

A1. The personal hydration system (10) of paragraph A, wherein the flexible bladder (12) is constructed of a film or sheet material.

A2. The personal hydration system (10) of any of paragraphs A-A1, wherein the flexible bladder (12) comprises a base (26) opposite the opening (20), and wherein the flexible bladder (12) defines a longitudinal axis (28) that extends between and through the opening (20) and the base (26).

A2.1. The personal hydration system (10) of any of paragraphs A-A2, wherein the flexible bladder (12) is constructed of one or more bladder panels (76).

A2.2. The personal hydration system (10) of any of paragraphs A-A2.1, wherein the flexible bladder (12) has a front side wall (78), a rear side wall (80) opposite the front side wall (78) relative to the longitudinal axis (28), a first edge side wall (82) extending between the front side wall (78) and the rear side wall (80), and a second edge side wall (84) opposite the first edge side wall (82) relative to the longitudinal axis (28).

A2.2.0. The personal hydration system (10) of paragraph A2.2, wherein the front side wall (78), the rear side wall (80), the first edge side wall (82), and the second edge side wall (84) extend from the opening (20) to the base (26).

A2.2.1. The personal hydration system (10) of any of paragraphs A2.2-A2.2.0, wherein the exit port (22) is coupled to one of the front side wall (78) or the rear side wall (80).

A2.2.2. The personal hydration system (10) of any of paragraphs A2.2-A2.2.0, wherein the exit port (22) is coupled to one of the first edge side wall (82) or the second edge side wall (84).

A2.2.3. The personal hydration system (10) of any of paragraphs A2.2-A2.2.2, wherein the flexible bladder (12) comprises one or more baffles (92) extending between the front side wall (78) and the rear side wall (80) within the internal compartment (14) and configured to maintain the front side wall (78) and the rear side wall (80) within a threshold distance of each other.

A2.2.3.1. The personal hydration system (10) of paragraph A2.2.3, wherein the one or more baffles (92) are configured to be selectively released to permit the front side wall (78) and the rear side wall (80) to be spaced apart greater than the threshold distance, and further wherein the one or more baffles (92) are further configured to be selectively reattached after being released.

A2.2.3.2. The personal hydration system (10) of any of paragraphs A2.2.3-A2.2.3.1 when depending from paragraph A2.2.2, wherein the one or more baffles (92) have a baffle depth (94), wherein the exit port (22) has a maximum port depth (90), and wherein the baffle depth (94) is greater than the maximum port depth (90).

A3. The personal hydration system (10) of any of paragraphs A-A2.2.3.2, wherein the fill port assembly (18) comprises one or more flexible and resilient fill port panels (30) coupled to the flexible bladder (12) adjacent to the opening (20), wherein the opening (20) has a closed configuration, in which drink liquid (16) is restricted from passing through the opening (20), and a range of open configurations, in which drink liquid (16) is permitted to pass through the opening (20), and wherein the one or more flexible and resilient fill port panels (30) bias the opening (20) toward the closed configuration.

A3.1. The personal hydration system (10) of paragraph A3, wherein the fill port assembly (18) further comprises a slider (32) configured to selectively engage the one or more flexible and resilient fill port panels (30) to maintain the opening (20) in the closed configuration and to be selectively disengaged from the one or more flexible and resilient fill port panels (30) to permit the opening (20) to be selectively transitioned into the range of open configurations.

A3.1.1. The personal hydration system (10) of paragraph A3.1, wherein the fill port assembly (18) further comprises a tether (34) coupled between the slider (32) and the flexible bladder (12) or between the slider (32) and the one or more flexible and resilient fill port panels (30).

A3.1.2. The personal hydration system (10) of any of paragraphs A3.1-A3.1.1, wherein at least one of the one or more flexible and resilient fill port panels (30) is configured to be folded relative to the flexible bladder (12) to configure the one or more flexible and resilient fill port panels (30) for operative engagement by the slider (32).

A3.2. The personal hydration system (10) of any of paragraphs A3-A3.1.2, wherein the one or more flexible and resilient fill port panels (30) are stiffer than the flexible bladder (12).

A3.3. The personal hydration system (10) of any of paragraphs A3-A3.2, wherein the one or more flexible and resilient fill port panels (30) comprise a first flexible and resilient fill port panel (52) coupled to the flexible bladder (12) on one side of the opening (20) and a second flexible and resilient fill port panel (54) coupled to the flexible bladder (12) on another side of the opening (20) opposite the first flexible and resilient fill port panel (52), and wherein the second flexible and resilient fill port panel (54) is stiffer than the first flexible and resilient fill port panel (52).

A3.4. The personal hydration system (10) of any of paragraphs A3-A3.3, wherein the one or more flexible and resilient fill port panels (30) have an unfolded configuration, in which the opening (20) is permitted to transition toward the range of open configurations, and a folded configuration, in which the opening (20) is in the closed configuration and is restricted from transitioning toward the range of open configurations.

A3.4.1. The personal hydration system (10) of paragraph A3.3, wherein the fill port assembly (18) defines a fold line (64), and wherein at least one of the one or more flexible and resilient fill port panels (30) is positioned wholly on one side of the fold line (64).

A4. The personal hydration system (10) of any of paragraphs A-A3.4.1, wherein the reservoir assembly (11) further comprises a downstream assembly (102) comprising an elongate drink tube (36) operatively coupled to the exit port (22) and configured to receive drink liquid (16) from the internal compartment (14) via the exit port (22) for delivery to a user.

A4.1. The personal hydration system (10) of paragraph A4, wherein the downstream assembly (102) further comprises a mouthpiece (38) operatively coupled to the elongate drink tube (36) and configured to dispense drink liquid (16) via the elongate drink tube (36).

A5. The personal hydration system (10) of any of paragraphs A-A4.1, wherein the reservoir assembly (11) further comprises an elongate flexible handle (40) operatively coupled relative to the flexible bladder (12) and the fill port assembly (18), wherein the elongate flexible handle (40) and at least the flexible bladder (12) collectively define a hand passage (42) extending between the elongate flexible handle (40) and the flexible bladder (12).

A5.1. The personal hydration system (10) of paragraph A5, wherein the elongate flexible handle (40) is sized for at least a portion, and optionally at least a substantial portion, of a human hand to extend through the hand passage (42).

A5.1.1. The personal hydration system (10) of paragraph A5 or paragraph A5.1, when depending from paragraph A2, wherein the hand passage (42) is transverse to the longitudinal axis (28).

A5.2. The personal hydration system (10) of any of paragraphs A5-A5.1, wherein the elongate flexible handle (40) extends parallel to the longitudinal axis (28) or is within 15 degrees of being parallel to the longitudinal axis (28).

A5.3. The personal hydration system (10) of any of paragraphs A5-A5.2, wherein the elongate flexible handle (40) has a ribbon shape.

A5.4. The personal hydration system (10) of any of paragraphs A5-A5.3, wherein the elongate flexible handle (40) is constructed at least partially of a webbing material.

A5.5. The personal hydration system (10) of any of paragraphs A5-A5.4, wherein the elongate flexible handle (40) is constructed at least partially of a fabric material, optionally a woven fabric material.

A5.6. The personal hydration system (10) of any of paragraphs A5-A5.5, wherein the elongate flexible handle (40) is constructed of a plastic-coated fabric.

A5.7. The personal hydration system (10) of any of paragraphs A5-A5.6, wherein the elongate flexible handle (40) is constructed of a weldable material.

A5.8. The personal hydration system (10) of any of paragraphs A5-A5.7, wherein the elongate flexible handle (40) is welded to the fill port assembly (18).

A5.9. The personal hydration system (10) of any of paragraphs A5-A5.8, wherein the elongate flexible handle (40) is conformable, and optionally non-resiliently conformable, to a dorsal surface of a user's hand that extends into the hand passage (42).

A5.10. The personal hydration system (10) of any of paragraphs A5-A5.9, wherein the fill port assembly (18) defines a slot (44), wherein the elongate flexible handle (40) extends through the slot (44), and wherein the elongate flexible handle (40) is secured to itself, optionally welded to itself, to retain the elongate flexible handle (40) to the fill port assembly (18).

A5.10.1. The personal hydration system (10) of paragraph A5.10, when depending from paragraph A3, wherein the one or more flexible and resilient fill port panels (30) defines the slot (44).

A5.10.1.1. The personal hydration system (10) of paragraph A5.10.1, when depending from paragraph A3.3, wherein the second flexible and resilient fill port panel (54) defines the slot (44).

A5.11. The personal hydration system (10) of any of paragraphs A5-A5.10.1.1, wherein the elongate flexible handle (40) is welded to the flexible bladder (12).

A5.12. The personal hydration system (10) of any of paragraphs A5-A5.11, wherein the reservoir assembly (11) further comprises:

a handle anchor (46) secured to the flexible bladder (12); wherein the elongate flexible handle (40) is secured to the handle anchor (46).

A5.12.1. The personal hydration system (10) of paragraph A5.12, wherein the handle anchor (46) is welded to the flexible bladder (12).

A5.12.2. The personal hydration system (10) of any of paragraphs A5.12-A5.12.1, wherein the elongate flexible handle (40) is welded to the handle anchor (46).

A5.12.3. The personal hydration system (10) of any of paragraphs A5.12-A5.12.2, wherein the handle anchor (46) is constructed of the same material as the elongate flexible handle (40).

A5.12.4. The personal hydration system (10) of any of paragraphs A5.12-A5.12.3, wherein the handle anchor (46) defines an anchor pocket (96), wherein the elongate flexible handle (40) extends into the anchor pocket (96).

A5.13. The personal hydration system (10) of any of paragraphs A5-A5.12.4, when depending from paragraph A2, wherein the reservoir assembly (11) has an overall height (48) aligned with the longitudinal axis (28), wherein the elongate flexible handle (40) has a handle height (50), and wherein the handle height (50) is between 20% and 50% of the overall height (48).

A6. The personal hydration system (10) of any of paragraphs A3-A5.13, when depending from paragraph A3, wherein at least one of the one or more flexible and resilient fill port panels (30) comprises one or more regions (56) of reduced thickness.

A6.1. The personal hydration system (10) of paragraph A6, wherein the at least one of the one or more flexible and resilient fill port panels (30) that comprises one or more regions (56) of reduced thickness has a respective panel height (58), and wherein the one or more regions (56) of reduced thickness do not span the respective panel height (58).

A6.2. The personal hydration system (10) of any of paragraphs A6-A6.1, wherein the at least one of the one or more flexible and resilient fill port panels (30) that comprises one or more regions (56) of reduced thickness has a respective panel width (60), and wherein the one or more regions (56) of reduced thickness are positioned within 20% of the respective panel width (60) from a lateral edge (62) of the fill port assembly (18).

A6.3. The personal hydration system (10) of any of paragraphs A6-A6.2, when depending from paragraph A3.4.1, wherein the at least one of the one or more flexible and resilient fill port panels (30) that comprises the one or more regions (56) of reduced thickness is the at least one of the one or more flexible and resilient fill port panels (30) that is positioned wholly on one side of the fold line (64).

A6.4. The personal hydration system (10) of any of paragraphs A6-A6.3, when depending from paragraph A3.3, wherein the first flexible and resilient fill port panel (52) comprises the at least one of the one or more flexible and resilient fill port panels (30) that comprises the one or more regions (56) of reduced thickness.

A6.5. The personal hydration system (10) of any of paragraphs A6-A6.4, when depending from paragraphs A3.4 and A2, wherein the at least one of the one or more flexible and resilient fill port panels (30) that comprises the one or more regions (56) of reduced thickness has a distal edge (66) that is further away from the base (26) when the fill port assembly (18) is in the unfolded configuration than when the fill port assembly (18) is in the folded configuration, and wherein the one or more regions (56) of reduced thickness extend from the distal edge (66).

A6.6. The personal hydration system (10) of any of paragraphs A6-A6.5, when depending from paragraph A2, wherein the one or more regions (56) of reduced thickness are linear and parallel to the longitudinal axis (28).

A6.7. The personal hydration system (10) of any of paragraphs A6-A6.6, wherein the at least one of the one or more flexible and resilient fill port panels (30) that comprises one or more regions (56) of reduced thickness is monolithic in construction.

A7. The personal hydration system (10) of any of paragraphs A2-A6.6, when depending from paragraph A2, wherein the base (26) extends generally perpendicular to the longitudinal axis (28) in two dimensions.

A7.1. The personal hydration system (10) of paragraph A7, wherein the reservoir assembly (11) further comprises a base frame (68) that is stiffer than the flexible bladder (12), and wherein the base frame (68) is coupled to the flexible bladder (12) to define the base (26).

A7.2. The personal hydration system (10) of any of paragraphs A7-A7.1, wherein the base (26) is constructed of a distinct sheet of material from a remainder of the flexible bladder (12) and is welded to the remainder of the flexible bladder (12).

A7.3. The personal hydration system (10) of any of paragraphs A7-A7.2, when depending from paragraph A2.2.2, wherein the base (26) has a maximum base depth (86) and a maximum base width (88) transverse to the maximum base depth (86), wherein the exit port (22) has a/the maximum port depth (90), and wherein the maximum base depth (86) is greater than the maximum port depth (90).

A7.4. The personal hydration system (10) of any of paragraphs A7-A7.3, when depending from paragraph A2.2, wherein the front side wall (78) has a front-side lower edge (98) and the rear side wall (80) has a rear-side lower edge (100), and wherein the front-side lower edge (98) and the rear-side lower edge (100) are spaced apart by the base (26).

A7.4.1. The personal hydration system (10) of paragraph A7.4, wherein the flexible bladder (12) is thicker along the front-side lower edge (98) and the rear-side lower edge (100) than the base (26) and a remainder of the front side wall (78) and the rear side wall (80) of the flexible bladder (12).

A7.5. The personal hydration system (10) of any of paragraphs A7-A7.4, when depending from paragraph A2.2, wherein the base (26) is stiffer than the front side wall (78) and the rear side wall (80).

A8. The personal hydration system (10) of any of paragraphs A2-A7.5 when depending from paragraph A2, wherein the reservoir assembly (11) further comprises a tab (70) coupled, optionally welded, to the base (26) within the internal compartment (14);

wherein the opening (20) is sized to permit a human hand to extend through the opening (20) to reach the tab (70);

wherein the tab (70) is configured to be engaged by the human hand; and wherein the flexible bladder (12) is sufficiently flexible to permit eversion of the flexible bladder (12) responsive to the human hand engaging the tab (70) and pulling the tab (70) and the base (26) through the opening (20).

A8.1. The personal hydration system (10) of paragraph A8, wherein the tab (70) comprises a ribbon (72) coupled to the base (26) at terminal ends of the ribbon (72), thereby defining a finger passage (74) sized to receive at least one finger of the human hand.

A8.1.1. The personal hydration system (10) of paragraph A8.1, wherein the ribbon (72) is sufficiently stiff to maintain opposed sides of the flexible bladder (12) that are adjacent to the ribbon (72) in a spaced-apart arrangement when the internal compartment is void of drink liquid (16).

As used herein, the phrase "at least substantially," when modifying a degree or relationship, includes not only the recited "substantial" degree or relationship, but also the full extent of the recited degree or relationship. A substantial amount of a recited degree or relationship may include at least 75% of the recited degree or relationship. For example, a first direction that is at least substantially parallel to a second direction includes a first direction that is within an angular deviation of 22.5° relative to the second direction and also includes a first direction that is identical to the second direction.

As used herein, the terms "selective" and "selectively," when modifying an action, movement, configuration, or other activity of one or more components or characteristics of an apparatus, mean that the specific action, movement, configuration, or other activity is a direct or indirect result of one or more dynamic processes, as described herein. The terms "selective" and "selectively" thus may characterize an activity that is a direct or indirect result of user manipulation of an aspect of, or one or more components of, the apparatus, or may characterize a process that occurs automatically, such as via the mechanisms disclosed herein.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

As used herein, the term "and/or" placed between a first entity and a second entity means one of (1) the first entity, (2) the second entity, and (3) the first entity and the second entity. Multiple entries listed with "and/or" should be construed in the same manner, i.e., "one or more" of the entities so conjoined. Other entities optionally may be present other than the entities specifically identified by the "and/or" clause, whether related or unrelated to those entities specifically identified. Thus, as a non-limiting example, a reference to "A and/or B," when used in conjunction with open-ended language such as "comprising," may refer, in one example, to A only (optionally including entities other than B); in another example, to B only (optionally including entities other than A); in yet another example, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

The various disclosed elements of apparatuses and steps of methods disclosed herein are not required to all apparatuses and methods according to the present disclosure, and the present disclosure includes all novel and non-obvious combinations and subcombinations of the various elements and steps disclosed herein. Moreover, one or more of the various elements and steps disclosed herein may define independent inventive subject matter that is separate and apart from the whole of a disclosed apparatus or method. Accordingly, such inventive subject matter is not required to be associated with the specific apparatuses and methods that are expressly disclosed herein, and such inventive subject matter may find utility in apparatuses and/or methods that are not expressly disclosed herein.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, when the disclosure or subsequently filed claims recite "a" or "a first" element or the equivalent thereof, such disclosure and/or claims should be understood to include incorporation of one or more such elements, neither requiring nor excluding two or more such elements.

The invention claimed is:

1. A personal hydration system (10), comprising a reservoir assembly (11), the reservoir assembly (11) comprising:

a flexible bladder (12) that defines an internal compartment (14) for holding a volume of drink liquid (16);

a fill port assembly (18) coupled to the flexible bladder (12) and defining an opening (20) to the internal compartment (14), wherein the fill port assembly (18) is configured to selectively seal the opening (20);

an exit port (22) coupled to the flexible bladder (12), wherein the exit port (22) defines a passage (24) for delivering drink liquid (16) from the internal compartment (14); and an elongate flexible handle (40) operatively coupled relative to the flexible bladder (12) and the fill port assembly (18), wherein the elongate flexible handle (40) and at least the flexible bladder (12) collectively define a hand passage (42) extending between the elongate flexible handle (40) and the flexible bladder (12), wherein the elongate flexible handle (40) is sized for at least a portion of a human hand to extend through the hand passage (42)); wherein the elongate flexible handle (40) is sufficiently flexible that it is configured to conform to the shape of a dorsal side of the human hand when the human hand extends through the hand passage (42) and to at least substantially lie against the flexible bladder (12) when the flexible bladder (12) is oriented in a horizontal orientation; and further wherein the elongate flexible bladder (40) is not constructed of a rigid, semi-rigid, or other material that defines a specific shape or fixed orientation to the elongate flexible bladder (40) relative to the flexible bladder (12) and the fill port assembly (18);

wherein the fill port assembly (18) defines a slot (44), wherein the elongate flexible handle (40) includes an upper end region (116) that forms a loop through the slot (44) to secure the elongate flexible handle (40) to the fill port assembly;

wherein the fill port assembly (18) comprises one or more flexible and resilient fill port panels (30) coupled to the flexible bladder (12) adjacent to the opening (20), wherein the opening (20) has a closed configuration, in which drink liquid (16) is restricted from passing through the opening (20), and a range of open configurations, in which drink liquid (16) is permitted to pass through the opening (20), and wherein the one or more flexible and resilient fill port panels (30) bias the opening (20) toward the closed configuration; and wherein the one or more flexible and resilient fill port panels (30) defines the slot (44).

2. The personal hydration system (10) of claim 1, wherein the flexible bladder (12) comprises a base (26) opposite the opening (20), and wherein the flexible bladder (12) defines a longitudinal axis (28) that extends between and through the opening (20) and the base (26); and wherein the hand passage (42) is transverse to the longitudinal axis (28).

3. The personal hydration system (10) of claim 1, wherein the elongate flexible handle (40) has a ribbon shape.

4. The personal hydration system (10) of claim 1, wherein the elongate flexible handle (40) is constructed of a plastic-coated fabric.

5. The personal hydration system (10) of claim 1, wherein the elongate flexible handle (40) is constructed of a weldable material.

6. The personal hydration system (10) of claim 1, wherein the elongate flexible handle (40) is welded to the fill port assembly (18).

7. The personal hydration system (10) of claim 1, wherein the one or more flexible and resilient fill port panels (30) comprise a first flexible and resilient fill port panel (52) coupled to the flexible bladder (12) on one side of the opening (20) and a second flexible and resilient fill port panel (54) coupled to the flexible bladder (12) on another side of the opening (20) opposite the first flexible and resilient fill port panel (52), and wherein the second flexible and resilient fill port panel (54) is stiffer than the first flexible and resilient fill port panel (52); and wherein the second flexible and resilient fill port panel (54) defines the slot (44).

8. The personal hydration system (10) of claim 1, wherein the flexible bladder (12) comprises a base (26) opposite the opening (20), and wherein the flexible bladder (12) defines a longitudinal axis (28) that extends between and through the opening (20) and the base (26);

wherein at least one of the one or more flexible and resilient fill port panels (30) comprises one or more regions (56) of reduced thickness, wherein the one or more regions (56) of reduced thickness are linear and parallel to the longitudinal axis (28);

wherein the at least one of the one or more flexible and resilient fill port panels (30) that comprises one or more regions (56) of reduced thickness has a respective panel height (58), and wherein the one or more regions (56) of reduced thickness do not span the respective panel height (58); and wherein the at least one of the one or more flexible and resilient fill port panels (30) that comprises one or more regions (56) of reduced thickness has a respective panel width (60), and wherein the one or more regions (56) of reduced thickness are positioned within 20% of the respective panel width (60) from a lateral edge (62) of the fill port assembly (18).

9. The personal hydration system (10) of claim 8, wherein the one or more flexible and resilient fill port panels (30) comprise a first flexible and resilient fill port panel (52) coupled to the flexible bladder (12) on one side of the opening (20) and a second flexible and resilient fill port panel (54) coupled to the flexible bladder (12) on another side of the opening (20) opposite the first flexible and resilient fill port panel (52), and wherein the second flexible and resilient fill port panel (54) is stiffer than the first flexible and resilient fill port panel (52);

wherein the fill port assembly (18) defines a fold line (64), and wherein at least one of the one or more flexible and resilient fill port panels (30) is positioned wholly on one side of the fold line (64); and wherein the at least one of the one or more flexible and resilient fill port panels (30) that comprises the one or more regions (56) of reduced thickness is the at least one of the one or more flexible and resilient fill port panels (30) that is positioned wholly on one side of the fold line (64).

10. The personal hydration system (10) of claim 1, wherein the reservoir assembly (11) further comprises a handle anchor (46) secured to the flexible bladder (12);

wherein the elongate flexible handle (40) is secured to the handle anchor (46); and wherein the handle anchor (46) defines an anchor pocket (96), and wherein the elongate flexible handle (40) extends into the anchor pocket (96).

11. The personal hydration system (10) of claim 10, wherein the elongate flexible handle (40) is welded to the handle anchor (46).

12. The personal hydration system (10) of claim 2, wherein the flexible bladder (12) has a front side wall (78), a rear side wall (80) opposite the front side wall (78) relative to the longitudinal axis (28), a first edge side wall (82) extending between the front side wall (78) and the rear side wall (80), and a second edge side wall (84) opposite the first edge side wall (82) relative to the longitudinal axis (28); and wherein the exit port (22) is coupled to one of the first edge side wall (82) or the second edge side wall (84).

13. The personal hydration system (10) of claim 12, wherein the flexible bladder (12) comprises one or more baffles (92) extending between the front side wall (78) and the rear side wall (80) within the internal compartment (14) and configured to maintain the front side wall (78) and the rear side wall (80) within a threshold distance of each other;

wherein the one or more baffles (92) are configured to be selectively released to permit the front side wall (78) and the rear side wall (80) to be spaced apart greater than the threshold distance, and further wherein the one or more baffles (92) are further configured to be selectively reattached after being released; and wherein the one or more baffles (92) have a baffle depth (94), wherein the exit port (22) has a maximum port depth (90), and wherein the baffle depth (94) is greater than the maximum port depth (90).

14. The personal hydration system (10) of claim 12, wherein the base (26) extends generally perpendicular to the longitudinal axis (28) in two dimensions.

15. The personal hydration system (10) of claim 14, wherein the reservoir assembly (11) further comprises a base frame (68) that is stiffer than the flexible bladder (12), and wherein the base frame (68) is coupled to the flexible bladder (12) to define the base (26).

16. The personal hydration system (10) of claim 14, wherein the base (26) has a maximum base depth (86) and a maximum base width (88) transverse to the maximum base depth (86), wherein the exit port (22) has a maximum port depth (90), and wherein the maximum base depth (86) is greater than the maximum port depth (90).

17. The personal hydration system (10) of claim 14, wherein the front side wall (78) has a front-side lower edge (98) and the rear side wall (80) has a rear-side lower edge (100), and wherein the front-side lower edge (98) and the rear-side lower edge (100) are spaced apart by the base (26); and wherein the flexible bladder (12) is thicker along the front-side lower edge (98) and the rear-side lower edge (100) than the base (26) and a remainder of the front side wall (78) and the rear side wall (80) of the flexible bladder (12).

18. The personal hydration system (10) of claim 14, wherein the base (26) is stiffer than the front side wall (78) and the rear side wall (80).

19. The personal hydration system (10) of claim 12, wherein the reservoir assembly (11) further comprises a tab (70) coupled to the base (26) within the internal compartment (14);

wherein the opening (20) is sized to permit a human hand to extend through the opening (20) to reach the tab (70);

wherein the tab (70) is configured to be engaged by the human hand; and wherein the flexible bladder (12) is sufficiently flexible to permit eversion of the flexible bladder (12) responsive to the human hand engaging the tab (70) and pulling the tab (70) and the base (26) through the opening (20).

20. The personal hydration system (10) of claim 2, wherein the reservoir assembly (11) further comprises a tab (70) coupled to the base (26) within the internal compartment (14);

wherein the opening (20) is sized to permit a human hand to extend through the opening (20) to reach the tab (70);

wherein the tab (70) is configured to be engaged by the human hand; and wherein the flexible bladder (12) is sufficiently flexible to permit eversion of the flexible bladder (12) responsive to the human hand engaging the tab (70) and pulling the tab (70) and the base (26) through the opening (20).

21. The personal hydration system (10) of claim 20, wherein the tab (70) comprises a ribbon (72) coupled to the base (26) at terminal ends of the ribbon (72), thereby defining a finger passage (74) sized to receive at least one finger of the human hand.

22. The personal hydration system (10) of claim 21, wherein the ribbon (72) is sufficiently stiff to maintain opposed sides of the flexible bladder (12) that are adjacent to the ribbon (72) in a spaced-apart arrangement when the internal compartment is void of drink liquid (16).

23. The personal hydration system (10) of claim 1, wherein the fill port assembly (18) comprises one or more flexible and resilient fill port panels (30) coupled to the flexible bladder (12) adjacent to the opening (20), wherein the opening (20) has a closed configuration, in which drink liquid (16) is restricted from passing through the opening (20), and a range of open configurations, in which the drink liquid (16) is permitted to pass through the opening (20), and wherein the one or more flexible and resilient fill port panels (30) bias the opening (20) toward the closed configuration; and wherein the elongate flexible handle (40) is secured to both the flexible bladder (12) and a flexible and resilient fill port panel (30) of the one or more flexible and resilient fill port panels (30) of the fill port assembly (18).

24. A personal hydration system (10), comprising a reservoir assembly (11), the reservoir assembly (11) comprising:

a flexible bladder (12) that defines an internal compartment (14) for holding a volume of drink liquid (16);

a fill port assembly (18) coupled to the flexible bladder (12) and defining an opening (20) to the internal compartment (14), wherein the fill port assembly (18) is configured to selectively seal the opening (20); wherein the fill port assembly (18) defines a slot (44); wherein the fill port assembly (18) comprises one or more flexible and resilient fill port panels (30) coupled to the flexible bladder (12) adjacent to the opening (20); wherein the opening (20) has a closed configuration, in which drink liquid (16) is restricted from passing through the opening (20), and a range of open configurations, in which drink liquid (16) is permitted to pass through the opening (20); wherein the one or more flexible and resilient fill port panels (30) bias the opening (20) toward the closed configuration; and wherein the one or more flexible and resilient fill port panels (30) defines the slot (44);

an exit port (22) coupled to the flexible bladder (12), wherein the exit port (22) defines a passage (24) for delivering drink liquid (16) from the internal compartment (14); and an elongate flexible handle (40) operatively coupled relative to the flexible bladder (12) and the fill port assembly (18), wherein the elongate flexible handle (40) and at least the flexible bladder (12) collectively define a hand passage (42) extending between the elongate flexible handle (40) and the flexible bladder (12), wherein the elongate flexible handle (40) is sized for at least a portion of a human hand to extend through the hand passage (42); wherein the elongate flexible handle (40) includes an upper end region (116) that forms a loop through the slot (44) to secure the elongate flexible handle (40) to the fill port assembly;

wherein the one or more flexible and resilient fill port panels (30) comprise a first flexible and resilient fill port panel (52) coupled to the flexible bladder (12) on one side of the opening (20) and a second flexible and resilient fill port panel (54) coupled to the flexible bladder (12) on another side of the opening (20) opposite the first flexible and resilient fill port panel (52), and wherein the second flexible and resilient fill port panel (54) is stiffer than the first flexible and resilient fill port panel (52); and wherein the second flexible and resilient fill port panel (54) defines the slot (44).

25. A personal hydration system (10), comprising a reservoir assembly (11), the reservoir assembly (11) comprising:

a flexible bladder (12) that defines an internal compartment (14) for holding a volume of drink liquid (16);

a fill port assembly (18) coupled to the flexible bladder (12) and defining an opening (20) to the internal compartment (14), wherein the fill port assembly (18) is configured to selectively seal the opening (20); wherein the fill port assembly (18) defines a slot (44); wherein the fill port assembly (18) comprises one or more flexible and resilient fill port panels (30) coupled to the flexible bladder (12) adjacent to the opening (20); wherein the opening (20) has a closed configuration, in which drink liquid (16) is restricted from passing through the opening (20), and a range of open configurations, in which drink liquid (16) is permitted to pass through the opening (20); wherein the one or more flexible and resilient fill port panels (30) bias the opening (20) toward the closed configuration; and wherein the one or more flexible and resilient fill port panels (30) defines the slot (44);

an exit port (22) coupled to the flexible bladder (12), wherein the exit port (22) defines a passage (24) for delivering drink liquid (16) from the internal compartment (14); and an elongate flexible handle (40) operatively coupled relative to the flexible bladder (12) and the fill port assembly (18), wherein the elongate flexible handle (40) and at least the flexible bladder (12) collectively define a hand passage (42) extending between the elongate flexible handle (40) and the flexible bladder (12), wherein the elongate flexible handle (40) is sized for at least a portion of a human hand to extend through the hand passage (42); wherein the elongate flexible handle (40) includes an upper end region (116) that forms a loop through the slot (44) to secure the elongate flexible handle (40) to the fill port assembly;

wherein the flexible bladder (12) comprises a base (26) opposite the opening (20), and wherein the flexible bladder (12) defines a longitudinal axis (28) that extends between and through the opening (20) and the base (26);

wherein at least one of the one or more flexible and resilient fill port panels (30) comprises one or more regions (56) of reduced thickness, wherein the one or more regions (56) of reduced thickness are linear and parallel to the longitudinal axis (28);

wherein the at least one of the one or more flexible and resilient fill port panels (30) that comprises one or more regions (56) of reduced thickness has a respective panel height (58), and wherein the one or more regions (56) of reduced thickness do not span the respective panel height (58); and wherein the at least one of the one or more flexible and resilient fill port panels (30) that comprises one or more regions (56) of reduced thickness has a respective panel width (60), and wherein the one or more regions (56) of reduced thickness are positioned within 20% of the respective panel width (60) from a lateral edge (62) of the fill port assembly (18).

26. The personal hydration system (10) of claim 25, wherein the one or more flexible and resilient fill port panels (30) comprise a first flexible and resilient fill port panel (52) coupled to the flexible bladder (12) on one side of the opening (20) and a second flexible and resilient fill port panel (54) coupled to the flexible bladder (12) on another side of the opening (20) opposite the first flexible and resilient fill port panel (52), and wherein the second flexible and resilient fill port panel (54) is stiffer than the first flexible and resilient fill port panel (52);

wherein the fill port assembly (18) defines a fold line (64), and wherein at least one of the one or more flexible and resilient fill port panels (30) is positioned wholly on one side of the fold line (64); and wherein the at least one of the one or more flexible and resilient fill port panels (30) that comprises the one or more regions (56) of reduced thickness is the at least one of the one or more flexible and resilient fill port panels (30) that is positioned wholly on one side of the fold line (64).

27. The personal hydration system (10) of claim 24, wherein the flexible bladder (12) comprises a base (26) opposite the opening (20), and wherein the flexible bladder (12) defines a longitudinal axis (28) that extends between and through the opening (20) and the base (26);

wherein at least one of the one or more flexible and resilient fill port panels (30) comprises one or more regions (56) of reduced thickness, wherein the one or more regions (56) of reduced thickness are linear and parallel to the longitudinal axis (28);

wherein the at least one of the one or more flexible and resilient fill port panels (30) that comprises one or more regions (56) of reduced thickness has a respective panel height (58), and wherein the one or more regions (56) of reduced thickness do not span the respective panel height (58); and wherein the at least one of the one or more flexible and resilient fill port panels (30) that comprises one or more regions (56) of reduced thickness has a respective panel width (60), and wherein the one or more regions (56)

of reduced thickness are positioned within 20% of the respective panel width (60) from a lateral edge (62) of the fill port assembly (18).

28. The personal hydration system (10) of claim 27, wherein the one or more flexible and resilient fill port panels (30) comprise a first flexible and resilient fill port panel (52) coupled to the flexible bladder (12) on one side of the opening (20) and a second flexible and resilient fill port panel (54) coupled to the flexible bladder (12) on another side of the opening (20) opposite the first flexible and resilient fill port panel (52), and wherein the second flexible and resilient fill port panel (54) is stiffer than the first flexible and resilient fill port panel (52);

wherein the fill port assembly (18) defines a fold line (64), and wherein at least one of the one or more flexible and resilient fill port panels (30) is positioned wholly on one side of the fold line (64); and wherein the at least one of the one or more flexible and resilient fill port panels (30) that comprises the one or more regions (56) of reduced thickness is the at least one of the one or more flexible and resilient fill port panels (30) that is positioned wholly on one side of the fold line (64).

29. The personal hydration system (10) of claim 25, wherein the flexible bladder (12) comprises a base (26) opposite the opening (20), and wherein the flexible bladder (12) defines a longitudinal axis (28) that extends between and through the opening (20) and the base (26);

wherein at least one of the one or more flexible and resilient fill port panels (30) comprises one or more regions (56) of reduced thickness, wherein the one or more regions (56) of reduced thickness are linear and parallel to the longitudinal axis (28);

wherein the at least one of the one or more flexible and resilient fill port panels (30) that comprises one or more regions (56) of reduced thickness has a respective panel height (58), and wherein the one or more regions (56) of reduced thickness do not span the respective panel height (58); and wherein the at least one of the one or more flexible and resilient fill port panels (30) that comprises one or more regions (56) of reduced thickness has a respective panel width (60), and wherein the one or more regions (56) of reduced thickness are positioned within 20% of the respective panel width (60) from a lateral edge (62) of the fill port assembly (18).

30. The personal hydration system (10) of claim 29, wherein the one or more flexible and resilient fill port panels (30) comprise a first flexible and resilient fill port panel (52) coupled to the flexible bladder (12) on one side of the opening (20) and a second flexible and resilient fill port panel (54) coupled to the flexible bladder (12) on another side of the opening (20) opposite the first flexible and resilient fill port panel (52), and wherein the second flexible and resilient fill port panel (54) is stiffer than the first flexible and resilient fill port panel (52);

wherein the fill port assembly (18) defines a fold line (64), and wherein at least one of the one or more flexible and resilient fill port panels (30) is positioned wholly on one side of the fold line (64); and wherein the at least one of the one or more flexible and resilient fill port panels (30) that comprises the one or more regions (56) of reduced thickness is the at least one of the one or more flexible and resilient fill port panels (30) that is positioned wholly on one side of the fold line (64).

* * * * *